US010518993B2

(12) United States Patent
Fujiwara et al.

(10) Patent No.: US 10,518,993 B2
(45) Date of Patent: Dec. 31, 2019

(54) PAPER SHEET STORING APPARATUS, PAPER SHEET HANDLING APPARATUS, AND PAPER SHEET FEEDING METHOD

(71) Applicant: FUJITSU FRONTECH LIMITED, Inagi (JP)

(72) Inventors: Ryo Fujiwara, Inagi (JP); Hiroshi Yanagida, Inagi (JP); Yasushi Gotoh, Inagi (JP); Koichi Hosoyama, Inagi (JP)

(73) Assignee: FUJITSU FRONTECH LIMITED, Inagi (JP)

( * ) Notice: Subject to any disclaimer, the term of this patent is extended or adjusted under 35 U.S.C. 154(b) by 0 days.

(21) Appl. No.: 15/995,214

(22) Filed: Jun. 1, 2018

(65) Prior Publication Data

US 2018/0273315 A1 Sep. 27, 2018

Related U.S. Application Data

(63) Continuation of application No. PCT/JP2015/086139, filed on Dec. 24, 2015.

(51) Int. Cl.
*B65H 3/06* (2006.01)
*G07F 19/00* (2006.01)
(Continued)

(52) U.S. Cl.
CPC ..... *B65H 3/06* (2013.01); *B65H 3/063* (2013.01); *B65H 3/0669* (2013.01); *B65H 5/06* (2013.01);
(Continued)

(58) Field of Classification Search
CPC ..... B65H 3/063; B65H 3/0669; B65H 1/06; B65H 3/06; B65H 2403/20;
(Continued)

(56) References Cited

U.S. PATENT DOCUMENTS 4,971,310 A * 11/1990 Motegi ..... B65H 1/06 271/126
4,993,587 A * 2/1991 Abe ..... B65H 3/063 221/21
(Continued)

FOREIGN PATENT DOCUMENTS

EP 2458567 5/2012
JP 5-242126 9/1993
(Continued)

OTHER PUBLICATIONS

Extended European Search Report, dated Dec. 14, 2018, in European Application No. 15911363.8 (7 pp.).
(Continued)

*Primary Examiner* — David H Bollinger
(74) *Attorney, Agent, or Firm* — Staas & Halsey LLP

(57) ABSTRACT

In a paper sheet storing apparatus housed in a paper sheet handling apparatus, a storage part stores paper sheets. An ejection port ejects a paper sheet of the paper sheets stored in the storage part. A first roller is arranged near the ejection port, and is rotated in a predetermined direction by transmission of rotation caused by drive of a drive shaft so as to send out the paper sheet from the ejection port. A driven shaft is rotated in the predetermined direction following the rotation of the first roller. A second roller is arranged in a position farther from the ejection port than a first roller, and is rotated in the predetermined direction by transmission of rotation of the driven shaft so as to sequentially feed, to the first roller, the paper sheets from a paper sheet positioned in a lowest layer among the paper sheets.

6 Claims, 20 Drawing Sheets

(51) Int. Cl.

| | |
|---|---|
| ***B65H 5/06*** | (2006.01) |
| ***G07D 11/16*** | (2019.01) |
| ***G07D 11/10*** | (2019.01) |
| ***G07D 11/40*** | (2019.01) |

(52) U.S. Cl.
CPC ..... *G07D 11/10* (2019.01); *G07D 11/16* (2019.01); *G07D 11/40* (2019.01); *G07F 19/20* (2013.01); *B65H 2403/20* (2013.01); *B65H 2403/72* (2013.01); *B65H 2405/313* (2013.01); *B65H 2701/1912* (2013.01); *G07D 2211/00* (2013.01)

(58) Field of Classification Search
CPC ..... B65H 2403/72; B65H 2405/313; G07D 11/0024; G07D 7/00; G07D 9/00; G07D 1/00; G07F 19/20
See application file for complete search history.

(56) References Cited

U.S. PATENT DOCUMENTS

| | | | | |
|---|---|---|---|---|
| 6,247,693 | B1 * | 6/2001 | Kawano | B65H 3/063 271/3.05 |
| 2010/0320678 | A1 | 12/2010 | Suzuki et al. | |
| 2014/0212256 | A1 * | 7/2014 | Haas | B41J 13/103 414/801 |
| 2014/0238814 | A1 * | 8/2014 | You | B65H 3/0607 194/206 |
| 2017/0140598 | A1 * | 5/2017 | Muta | G07D 11/14 |
| 2017/0313532 | A1 * | 11/2017 | Kawase | B65H 3/52 |
| 2018/0273312 | A1 * | 9/2018 | Gotoh | B65H 1/06 |

FOREIGN PATENT DOCUMENTS

| | | |
|---|---|---|
| JP | 9-198544 | 7/1997 |
| JP | 2002-167101 | 6/2002 |
| JP | 2010-267171 | 11/2010 |
| WO | WO 2010/086994 A1 | 8/2010 |

OTHER PUBLICATIONS

International Search Report dated Mar. 22, 2016 in corresponding International Patent Application No. PCT/JP2015/086139.
Written Opinion of the International Searching Authority dated Mar. 22, 2016 in corresponding International Patent Application No. PCT/JP2015/086139.
Chinese Office Action dated Apr. 25, 2019 in corresponding Chinese Patent Application No. 201580085386.3 (14 pages).

* cited by examiner

PAPER SHEET STORING APPARATUS, PAPER SHEET HANDLING APPARATUS, AND PAPER SHEET FEEDING METHOD

CROSS-REFERENCE TO RELATED APPLICATION

This application is a continuation application of International Application PCT/JP2015/086139, filed on Dec. 24, 2015 and designating the U.S., the entire contents of which are incorporated herein by reference.

FIELD

The present invention relates to a paper sheet storing apparatus, a paper sheet handling apparatus, and a paper sheet feeding method.

BACKGROUND

A paper-currency-bill handling apparatus such as an Automatic Teller Machine (ATM) includes a paper currency bill storing apparatus that stores paper currency bills. The paper currency bill storing apparatus simultaneously stores, for example, paper currency bills having different sizes and different denominations, and sequentially sends out paper currency bills to the outside of the paper-currency-bill handling apparatus by using synchronized rotations of a pick roller for picking up paper currency bills and a paper feeding roller for sending out the picked-up paper currency bills. The paper feeding roller is positioned closer to a paper currency bill ejecting port than the pick roller.

Meanwhile, the paper feeding roller is connected to a drive shaft via a one-way clutch, for example, and the pick roller is connected to a driven shaft via a one-way clutch, for example. The drive shaft and the driven shaft are connected with each other by using a belt. By employing the above configuration, drive of the drive shaft causes the paper feeding roller to rotate, and rotation of the driven shaft, to which the drive of the drive shaft is transmitted, causes the pick roller to rotate (see Patent Documents 1 to 3, for example).

Patent Document 1: Japanese Laid-open Patent Publication No. 2002-167101

Patent Document 2: Japanese Laid-open Patent Publication No. 05-242126

Patent Document 3: Japanese Laid-open Patent Publication No. 2010-267171

However, in the conventional technology, there exists a case where rotation starts of the respective rollers after a drive start of the drive shaft do not synchronize with each other due to play of the one-way clutch etc. and a timing difference between the rotation starts is generated in the pick roller and the paper feeding roller. There exists a problem that a jam (paper jam) of a paper currency bill occurs due to this timing difference. For example, during a period from a previous rotation start of the pick roller to the following rotation start of the paper feeding roller, a paper currency bill picked up by the pick roller is not sent out by the paper feeding roller, and thus a jam of the paper currency bill is generated. For example, when there exists a large-sized paper currency bill on a small-sized paper currency bill in the paper currency bill storing apparatus, the pick roller previously starts to rotate and a leading end of the small-sized paper currency bill is picked up by the pick roller so as to reach the paper feeding roller. Next, leading ends of the small-sized paper currency bill and the large-sized paper currency bill are pinched by the rotation started paper feeding roller, and the small-sized paper currency bill and the large-sized paper currency bill are sent out in an overlapped manner so as to generate the jam of the paper currency bill.

SUMMARY

According to an aspect of the embodiments, a paper sheet storing apparatus includes: a storage part that stores paper sheets; an ejection port that ejects a paper sheet of the paper sheets stored in the storage part; a drive shaft; a first roller that is arranged near the ejection port, and is rotated in a predetermined direction by transmission of rotation caused by drive of the drive shaft so as to send out the paper sheet stored in the storage part from the ejection port; a driven shaft that is rotated in the predetermined direction following the rotation of the first roller in the predetermined direction caused by the transmission of the driving rotation of the drive shaft; and a second roller that is arranged in a position farther from the ejection port than a position in which the first roller is arranged, and is rotated in the predetermined direction by transmission of rotation of the driven shaft in the predetermined direction so as to sequentially feed, to the first roller, the paper sheets stored in the storage part from a paper sheet positioned in a lowest layer among the paper sheets.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 6B-1 is a side view illustrating the paper currency bill storing apparatus (state where lid body is opened) according to the first embodiment viewed from the direction B illustrated in FIG. 5A;

FIG. 6B-2 is a cross sectional view illustrating the paper currency bill storing apparatus according to the first embodiment taken along a cross section I-I illustrated in FIG. 6A;

DESCRIPTION OF EMBODIMENTS

Hereinafter, exemplary embodiments of a paper sheet storing apparatus, a paper sheet handling apparatus, and a paper sheet feeding method disclosed in the present application will be described in detail with reference to the accompanying drawings. In the following embodiments, an Automatic Teller Machine (ATM) is exemplified as the paper sheet handling apparatus, and a paper currency bill cassette included in the ATM is exemplified as the paper sheet storing apparatus. However, the disclosed technology is not limited thereto. In other words, the disclosed technology may be generally applied to a paper sheet handling apparatus that stores paper sheets having different sizes in a cassette, which is able to store them in a mixed manner, sets the cassette in the paper sheet handling apparatus, and sends out a paper sheet from the cassette.

The following embodiments and modes of thereof may be appropriately combined within a consistent range with each other. Common configurations and processes are represented with same symbols and the description of the already-described configurations and processes is omitted appropriately. Positions in the embodiments of "up", "down", "left", "right", "front", "rear", etc. indicate relative positions in illustration.

First Embodiment

Exterior of Paper Currency Bill Handling Apparatus

Figure 1:
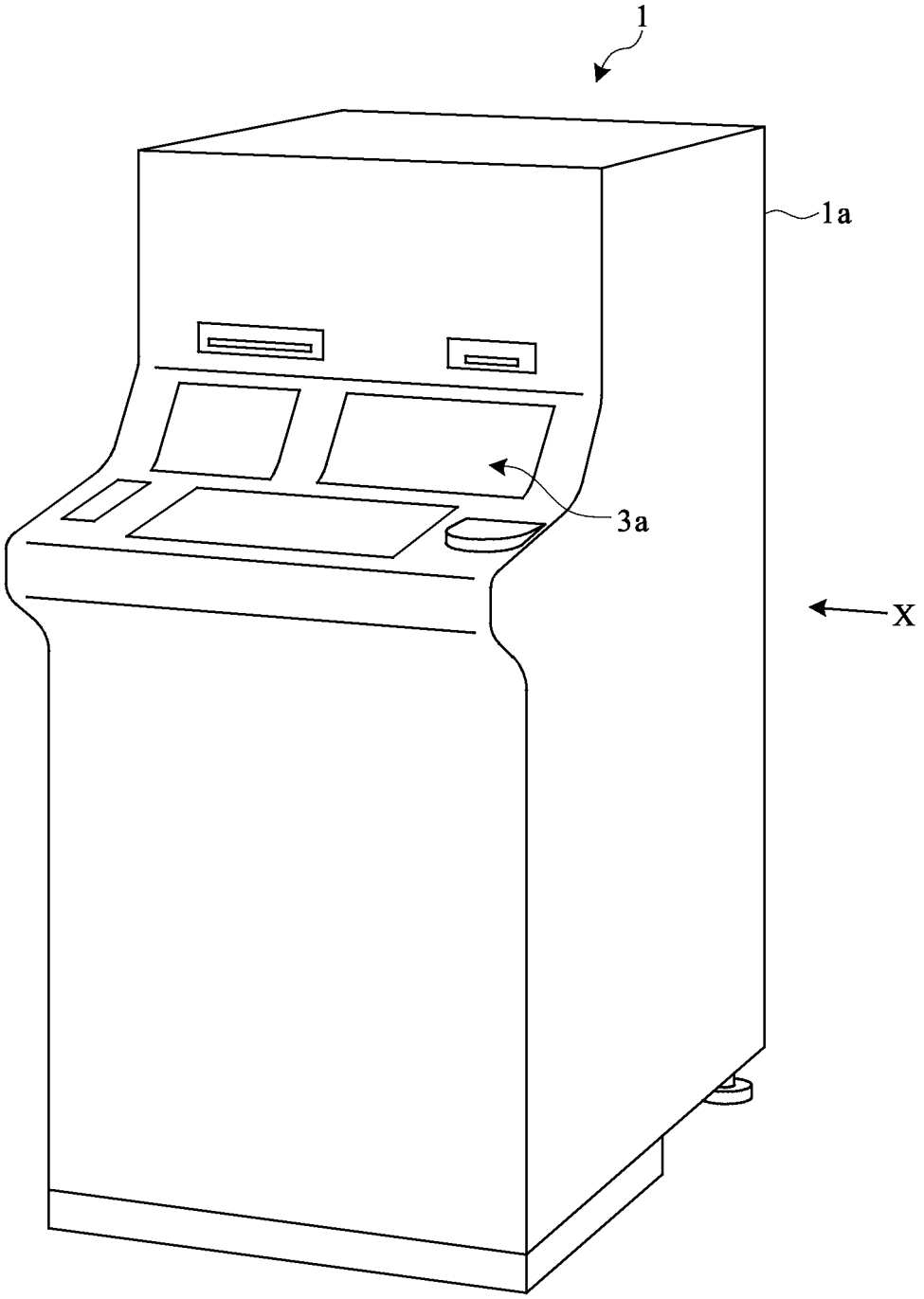
FIG. 1 is a perspective view illustrating an exterior of a paper currency bill handling apparatus according to a first embodiment.

FIG. 1 is a perspective view illustrating an exterior of a paper currency bill handling apparatus according to an embodiment. A paper currency bill handling apparatus 1 according to the embodiment includes, on a side of a casing la facing an operator, a display and operation panel, a passbook insertion port, a cash-card insertion port, a paper currency bill slot 3*a*, a coin slot, and a biological information reader for biometric identification among other things. The paper currency bill handling apparatus 1 further includes a door that is for opening an inner part of the paper currency bill handling apparatus 1 in order to set a paper currency bill storing apparatus 10 (see FIG. 2), which is a paper currency bill cassette, and the like in the inner part of the paper currency bill handling apparatus 1.

Configuration of Paper Currency Bill Handling Apparatus

Figure 2:
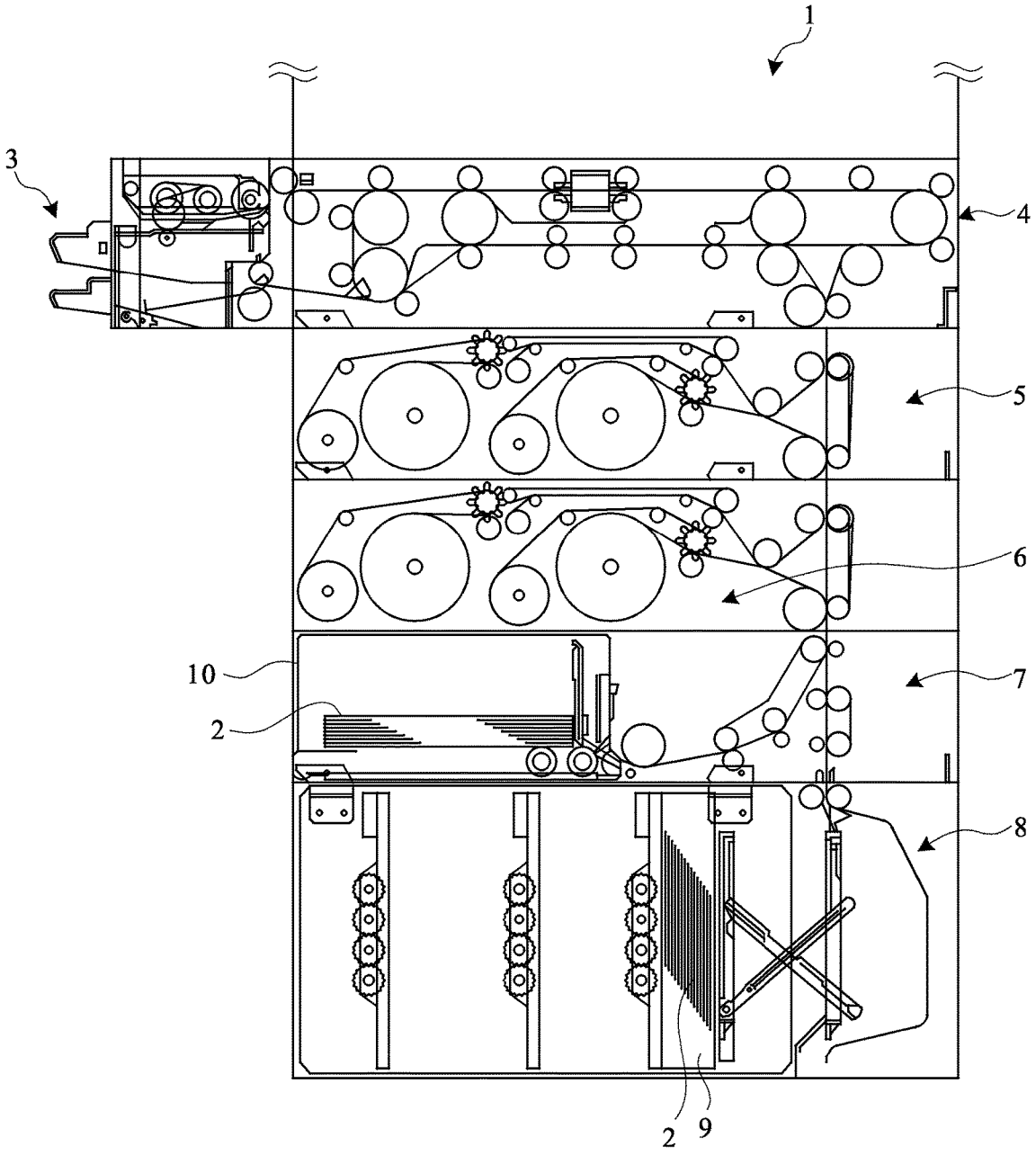
FIG. 2 is a schematic view illustrating a schematic configuration of the paper currency bill handling apparatus including a paper currency bill storing apparatus according to the first embodiment.

FIG. 2 is a schematic view illustrating a schematic configuration of the paper currency bill handling apparatus including the paper currency bill storing apparatus according to the embodiment. FIG. 2 is substantially a cross sectional view illustrating the paper currency bill handling apparatus 1 illustrated in FIG. 1 viewed from an X direction illustrated in FIG. 1. As illustrated in FIG. 2, the paper currency bill handling apparatus 1 according to the embodiment includes, inside the casing 1*a*, a bill deposit and withdrawal part 3 that deposits and withdraws a paper currency bill 2, a discrimination part 4 that discriminates the paper currency bill 2 deposited from the bill deposit and withdrawal part 3, and a temporarily housing part 5 that temporarily houses the paper currency bill 2 conveyed from the discrimination part 4. The bill deposit and withdrawal part 3 is positioned near the paper currency bill slot 3*a* (see FIG. 1). The paper currency bill handling apparatus 1 includes a returning part 6 that returns the paper currency bill 2 housed in the temporarily housing part 5, a money withdrawing part 7 in which the paper currency bill storing apparatus 10 housing the paper currency bills 2 to be withdrawn is set, and a storing part 8 that stores the paper currency bills 2 in a storing chamber 9.

The paper currency bill storing apparatus 10 is a cassette (or cartridge) for stacking the different-denomination paper currency bills 2 having a plurality of sizes on its plane and storing them so as to replenish the paper currency bill handling apparatus 1 with the stored paper currency bills 2. The difference in the size indicates the difference in the length, for example. The paper currency bill storing apparatus 10 is housed in the money withdrawing part 7 in a state where the paper currency bill storing apparatus 10 stores the paper currency bills 2. The paper currency bill storing apparatus 10 sequentially sends out the stored paper currency bills 2, and replenishes a recycle cassette (not illustrated) included in the returning part 6 with the paper currency bills 2, for example. In the embodiment, the paper currency bill storing apparatus 10 is one example of a paper sheet storing apparatus. In the embodiment, the paper currency bill 2 is employed for one example of a paper sheet, not limit the paper currency bill. In the embodiment, the paper currency bill storing apparatus 10 exemplified as a cassette for performing replenishment with the paper currency bills 2, may be another cassette for housing paper sheets.

Paper Currency Bill Storing Apparatus

Figure 3:
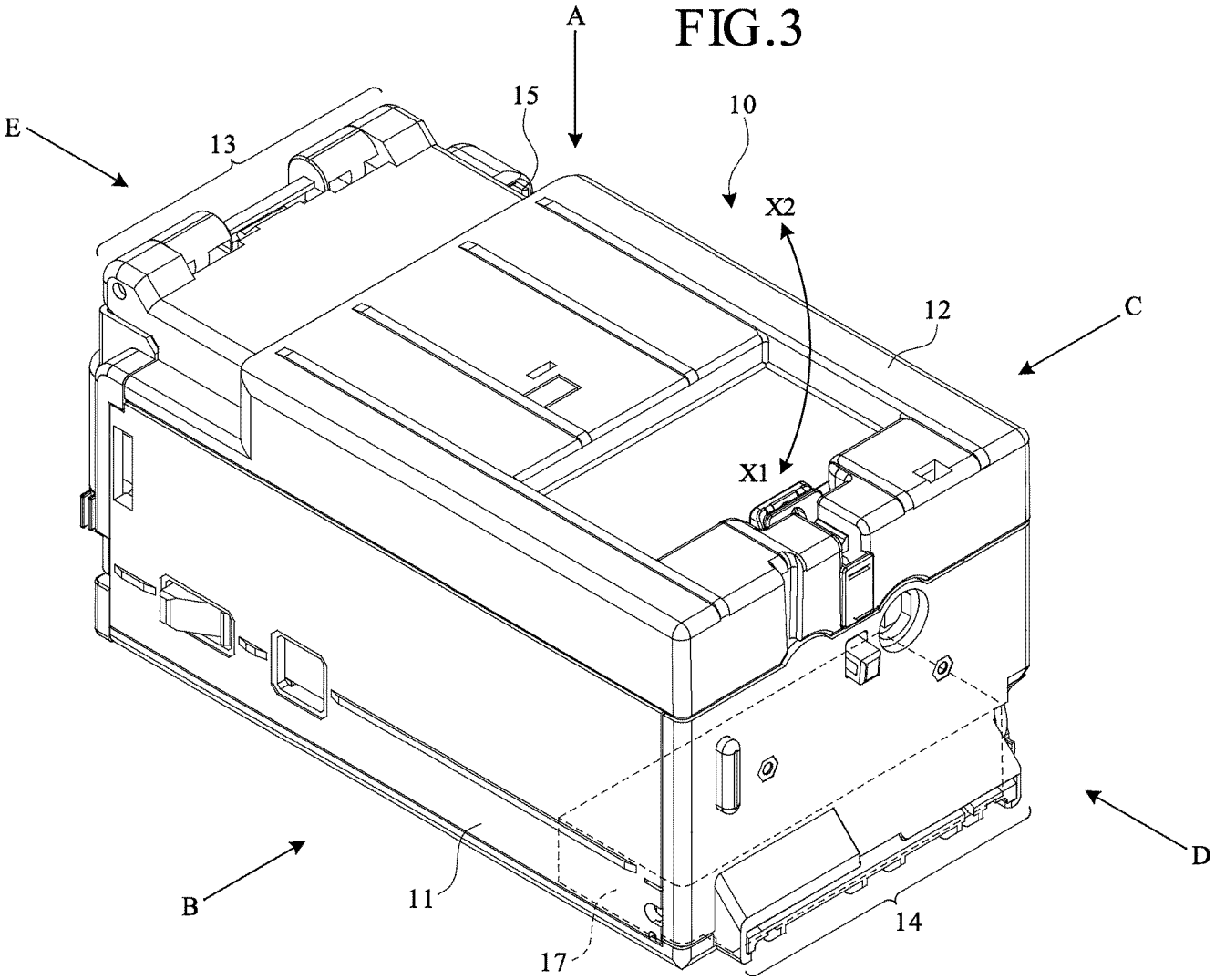
FIG. 3 is a perspective view illustrating the paper currency bill storing apparatus according to the first embodiment.
Figure 4A:
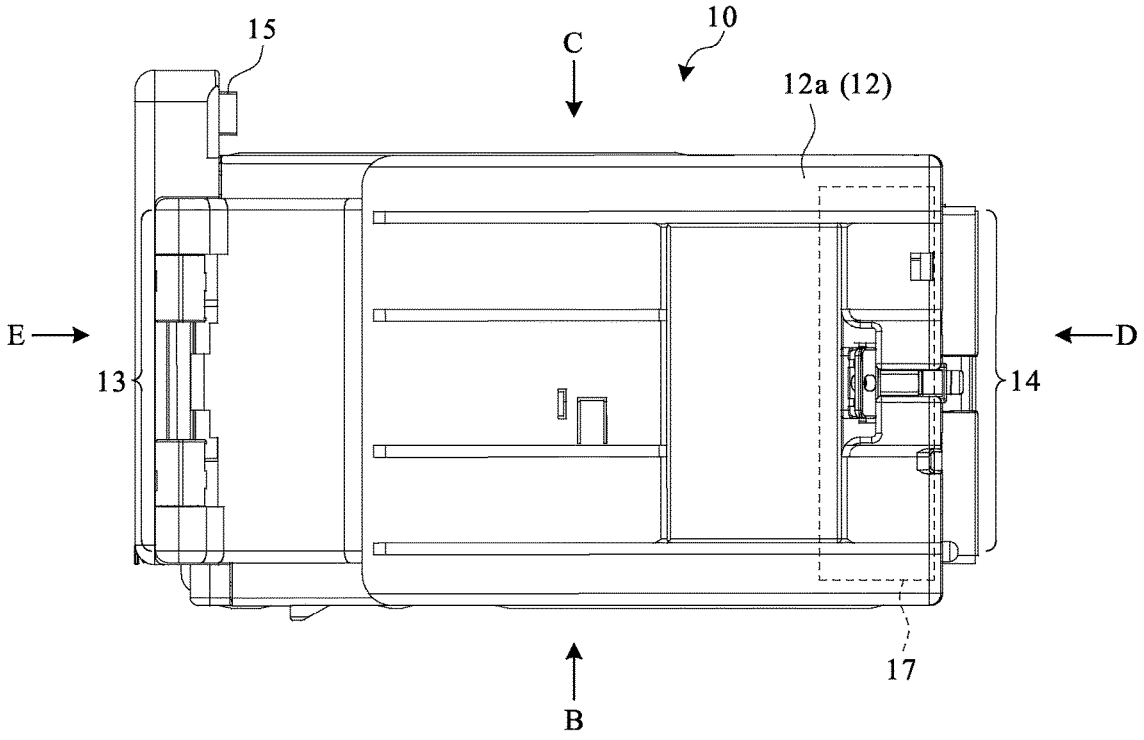
FIG. 4A is a plan view illustrating the paper currency bill storing apparatus according to the first embodiment viewed from a direction A illustrated in FIG. 3.
Figure 4B:
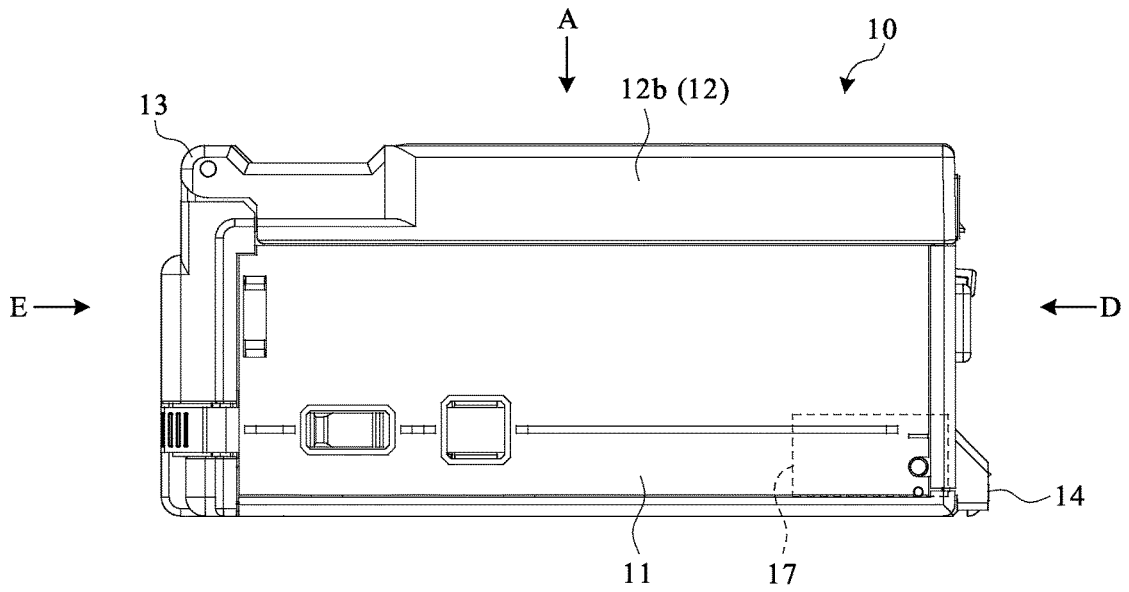
FIG. 4B is a side view illustrating the paper currency bill storing apparatus according to the first embodiment viewed from a direction B illustrated in FIG. 3.
Figure 4C:
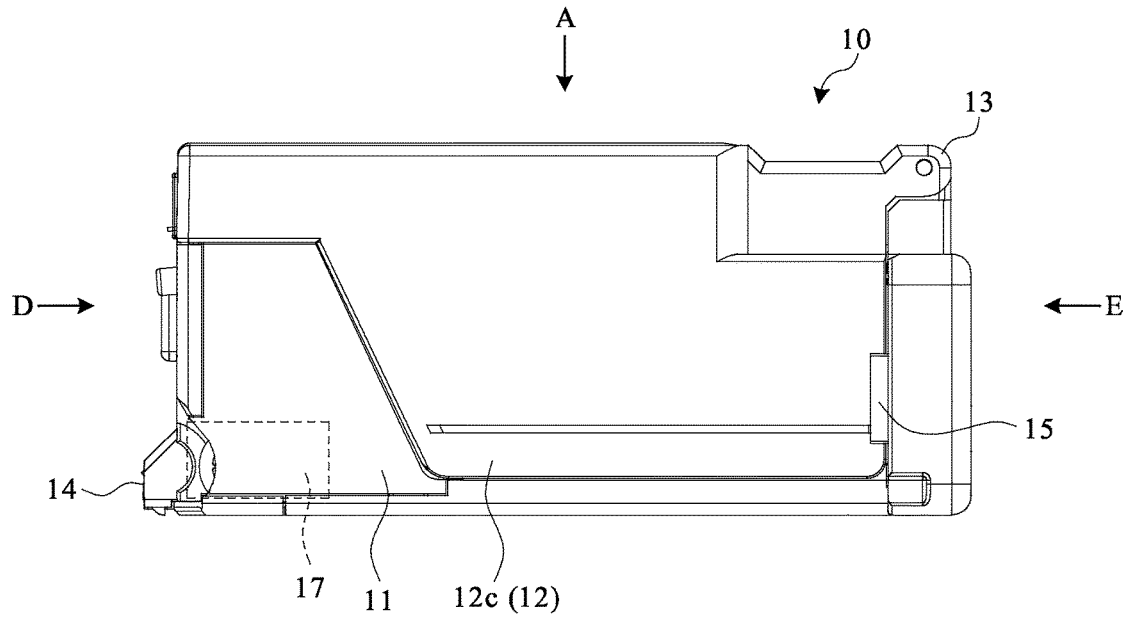
FIG. 4C is a side view illustrating the paper currency bill storing apparatus according to the first embodiment viewed from a direction C illustrated in FIG. 3.
Figure 4D:
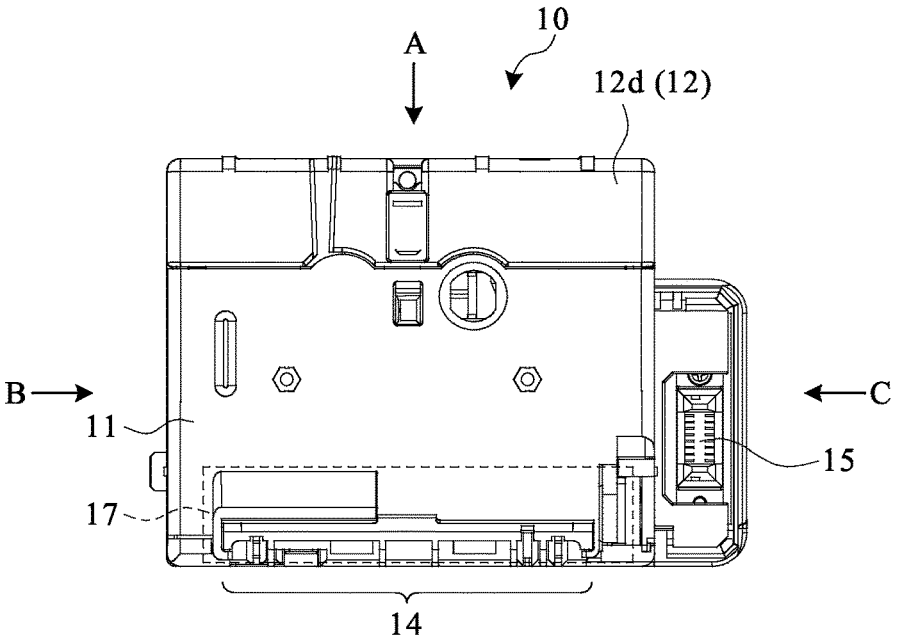
FIG. 4D is a front view illustrating the paper currency bill storing apparatus according to the first embodiment viewed from a direction D illustrated in FIG. 3.
Figure 4E:
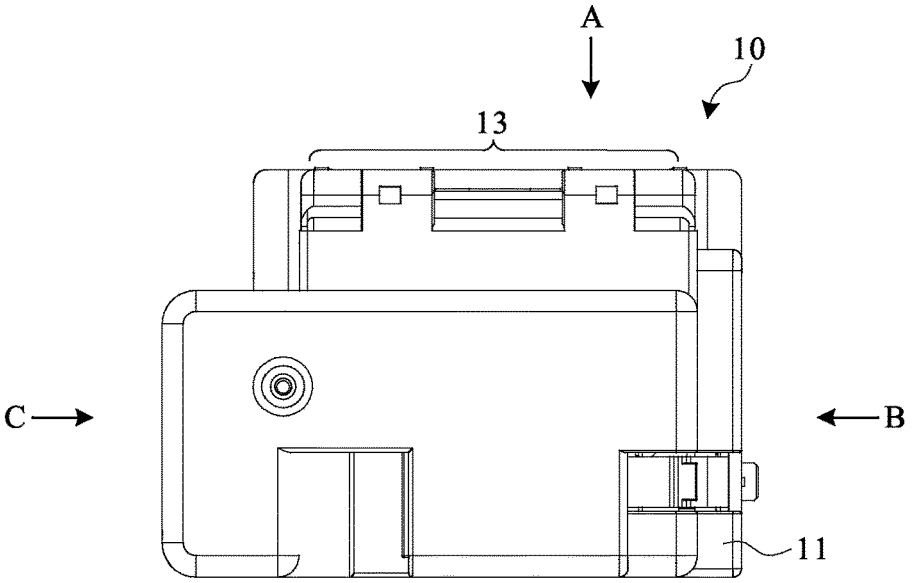
FIG. 4E is a rear view illustrating the paper currency bill storing apparatus according to the first embodiment viewed from a direction E illustrated in FIG. 3.

FIG. 3 is a perspective view illustrating the paper currency bill storing apparatus according to the embodiment. FIG. 4A is a plan view illustrating the paper currency bill storing apparatus according to the embodiment viewed from an direction A illustrated in FIG. 3. FIG. 4B is a side view illustrating the paper currency bill storing apparatus according to the embodiment viewed from a direction B illustrated in FIG. 3. FIG. 4C is a side view illustrating the paper currency bill storing apparatus according to the embodiment viewed from a direction C illustrated in FIG. 3. FIG. 4D is a front view illustrating the paper currency bill storing apparatus according to the embodiment viewed from a direction D illustrated in FIG. 3. FIG. 4E is a rear view illustrating the paper currency bill storing apparatus according to the embodiment viewed from a direction E illustrated in FIG. 3. Hereinafter, symbols of the directions A to E are commonly used in the drawings. The paper currency bill storing apparatus 10 is set into the money withdrawing part 7 of the paper currency bill handling apparatus 1 in the direction E.

As illustrated in FIGS. 3 and 4A to 4E, the paper currency bill storing apparatus 10 is rectangular shaped, and includes a main body 11, a lid body 12, a hinge 13, a paper currency bill ejecting port 14, and a connector 15. The paper currency bill storing apparatus 10 further includes therein a roller part 17 near the paper currency bill ejecting port 14. As described in the following, the lid body 12 is connected with the main body 11 via the hinge 13 and is to be half rotated for the main body 11 around a shaft of the hinge 13 as a rotation axis. The half rotation of the lid body 12 around the shaft of the hinge 13 as the rotation axis in a direction X1 illustrated in FIG. 3 causes a part, which is from the hinge 13 to a farthest part from the hinge 13, to unite with the main body 11 so as to cover an opened part of the main body 11, and forms a substantial rectangle shape along with the main body 11. The half rotation of the lid body 12 around the shaft of the hinge 13 as the rotation axis in a direction X2 illustrated in FIG. 3 causes the part, which is from the hinge 13 to the farthest part from the hinge 13, to separate from the main body 11 so as to open the lid, and the opened part of the main body 11 is exposed.

As illustrated in FIG. 4A, the lid body 12 includes a top panel surface 12*a* on the direction A side. As illustrated in FIG. 4B, the lid body 12 includes a side panel surface 12*b* on the direction B side. As illustrated in FIG. 4C, the lid body 12 includes a side panel surface 12*c* on the direction C side. As illustrated in FIG. 4D, the lid body 12 includes a side panel surface 12*d* on the direction D side. In other words, the lid body 12 is a lid body formed by the top panel surface 12*a*, the side panel surfaces 12*b* to 12*d*, and the hinge 13.

In the lid body 12, an area of the side panel surface 12*c* is larger than those of the side panel surfaces 12*b*, 12*d*. In other words, as is obvious when comparing FIGS. 4B and 4C with each other, the side panel surface 12*c* covers an almost whole region from an upper side to a lower side of the side surface of the paper currency bill storing apparatus 10, compared with the side panel surface 12*b*. This is because, as described in the following, the main body 11 of the paper currency bill storing apparatus 10 on the direction C side is more largely cut off than that on the direction B side, and is covered more broadly by the lid body 12.

The paper currency bill ejecting port 14 is an ejection port that ejects the paper currency bill 2 set in the paper currency bill storing apparatus 10. Details will be described in the following, the paper currency bill storing apparatus 10 includes the roller part 17 that includes therein a separate roller and a pick roller in this order from the paper currency bill ejecting port 14. A neighborhood of a longitudinal leading end of the paper currency bill 2 in a lowest layer, among the paper currency bills 2 stacked on a bottom surface part 16*a* (see FIGS. 5A and 5B) arranged in the paper currency bill storing apparatus 10, contacts with the pick roller, and the paper currency bill storing apparatus 10 sequentially feeds the paper currency bills 2 by rotation of the pick roller accompanied with the friction between the paper currency bill 2 and the pick roller. The paper currency bill 2 fed by the pick roller contacts with the separate roller by rotation of the separate roller accompanied with the friction between the paper currency bill 2 and the separate roller, and the paper currency bill storing apparatus 10 ejects the paper currency bill 2 to the outside of the paper currency bill storing apparatus 10 from the paper currency bill ejecting port 14. Details of the roller part 17 will be described later.

The connector 15 is connected to a predetermined terminal provided to the money withdrawing part 7 of the paper currency bill handling apparatus 1, and mediates: supplied power and control signals from a controller (not illustrated) of the paper currency bill handling apparatus 1 to the paper currency bill storing apparatus 10; and response signals from the paper currency bill storing apparatus 10 to the controller of the paper currency bill handling apparatus 1 among other things.

Paper Currency Bill Storing Apparatus with Lid-Body Opened State

Figure 5A:
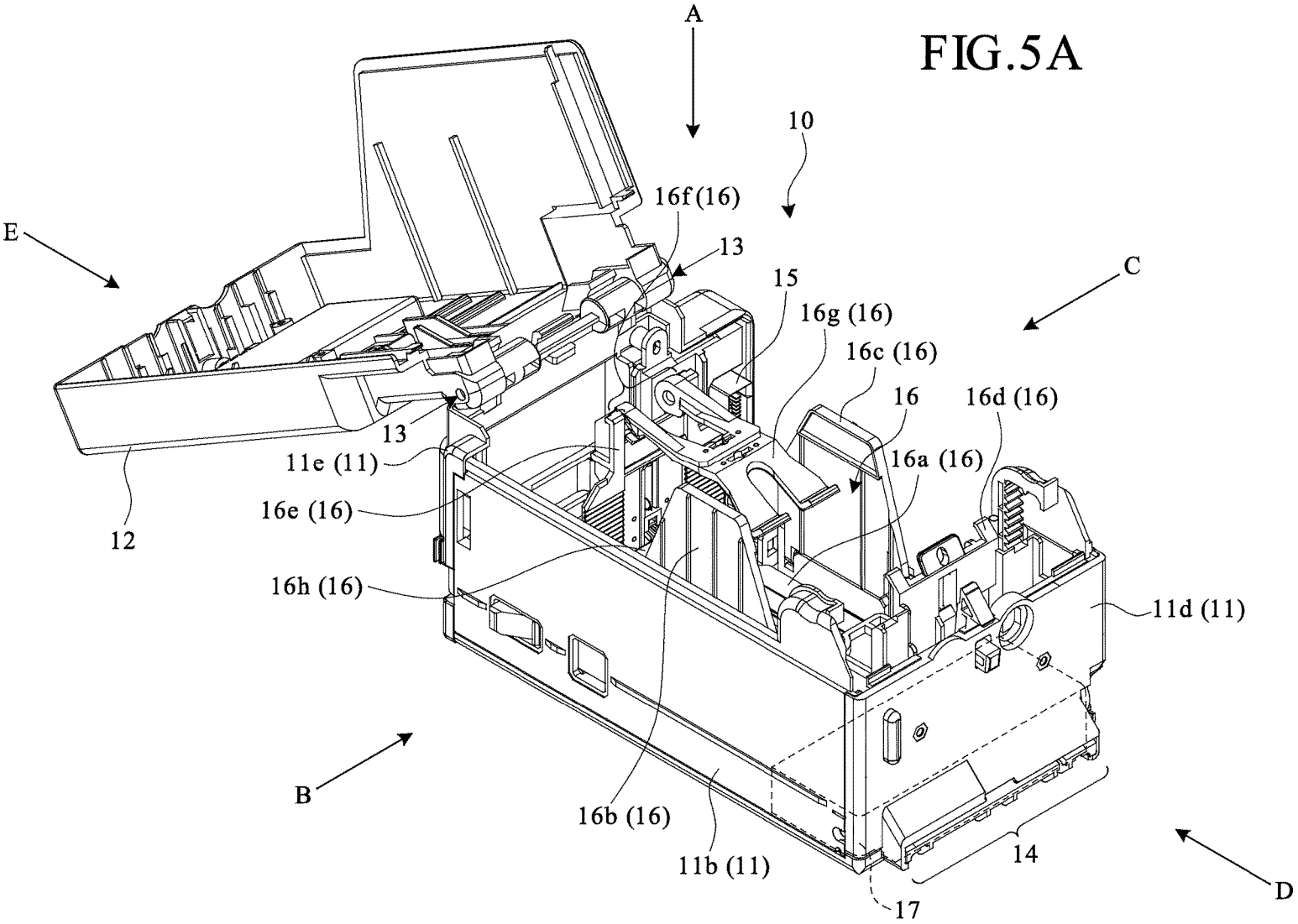
FIG. 5A is a perspective view illustrating an exterior (state where lid body is opened) of the paper currency bill storing apparatus according to the first embodiment.
Figure 5B:
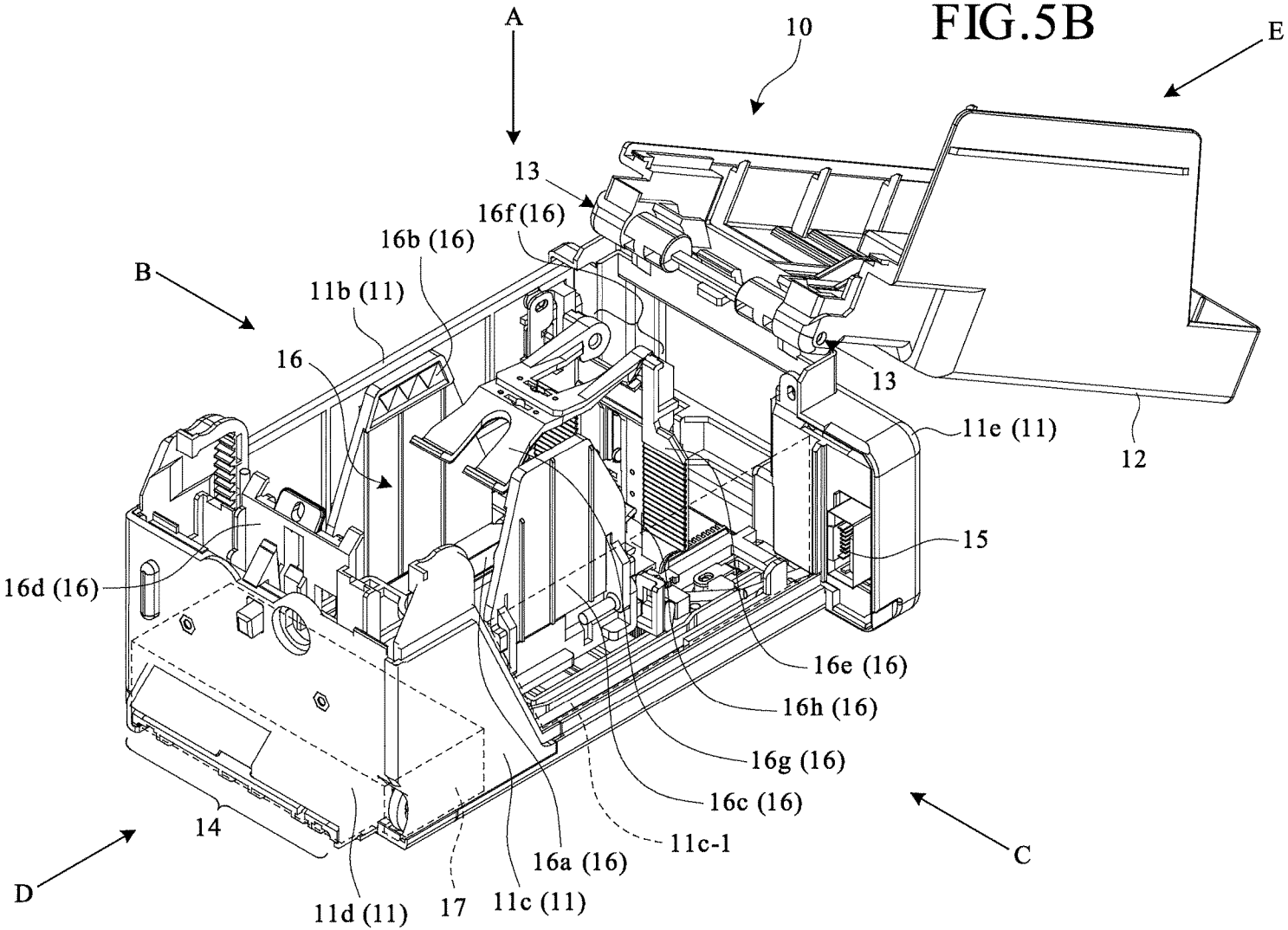
FIG. 5B is a perspective view illustrating an exterior (state where lid body is opened) of the paper currency bill storing apparatus according to the first embodiment.

FIGS. 5A and 5B are perspective views illustrating an exterior (state where lid body is opened) of the paper currency bill storing apparatus according to the embodiment. In FIG. 5A, the paper currency bill storing apparatus 10 viewed from the direction B is illustrated in the state where the lid body 12 is opened. In FIG. 5B, the paper currency bill storing apparatus 10 viewed from the direction C is illustrated in the state where the lid body 12 is opened.

As illustrated in FIGS. 5A and 5B, the main body 11 of the paper currency bill storing apparatus 10 includes, as erected surfaces for a bottom surface, an erected surface lib on the direction B side, an erected surface 11*c* on the direction C side, an erected surface 11*d* on the direction D side, and an erected surface 11*e* on the direction E side. The erected surface 11*c* is cut off to a neighborhood of the bottom surface of the main body 11 compared with the erected surface 11*b*.

The paper currency bill storing apparatus 10 includes a paper currency bill storing part 16 in a space surrounded by the bottom surface of the main body 11 and the erected surfaces lib to 11*e*. The paper currency bill storing part 16 is positioned on or above the bottom surface of the main body 11, and includes: the bottom surface part 16*a* on which the paper currency bills 2 or a paper-currency-bill bundle stored in the paper currency bill storing apparatus 10 are placed; and erection parts 16*b* to 16*e* that are erected from respective sides of the bottom surface part 16*a*. The erection part 16*b* is erected on the direction B side of the bottom surface part 16*a*. The erection part 16*c* is erected on the direction C side of the bottom surface part 16*a*. The erection part 16*d* is erected on the direction D side of the bottom surface part 16*a*. The erection part 16*e* is erected on the direction E side of the bottom surface part 16*a*.

The erection part 16*c* of the paper currency bill storing part 16 is able to be turned down from an erection base, which is erected from the bottom surface part 16*a* of the paper currency bill storing part 16, over a cut-off part 11*c*-1 of the erected surface 11*c* toward the outside of the paper currency bill storing apparatus 10. This is for setting the paper currency bills 2 from the direction C in a lateral direction over the cut-off part 11*c*-1 of the erected surface 11*c*, when the paper currency bills 2 are to be set into a paper currency bill storing space (to be mentioned later) of the paper currency bill storing part 16.

A paper-currency-bill back-end presser 16*g* is attached, to be half-rotatable around a shaft of a hinge 16*f* as a rotation axis, to an upper end of the erection part 16*e* via the hinge 16*f*. Details will be described later, a paper-currency-bill back-end lifter 16*h* is attached to the erection part 16*e*. A leading end of the paper-currency-bill back-end lifter 16*h* is directed to an inner part surrounded by the erection parts 16*b* to 16*e* and changes its height position in the erection part 16*e* in accordance with the weight of the paper currency bills 2.

In the paper currency bill storing apparatus 10, paper currency bills are able to be set in the paper currency bill storing space surrounded by the erection parts 16*b* to 16*e* of the paper currency bill storing part 16. The erection parts 16*b* to 16*e* of the paper currency bill storing apparatus 10 press the paper currency bills 2, which are set in the paper currency bill storing space, toward an inner side of the paper currency bill storing space by using position adjustments of the erection parts 16*b* to 16*e* in horizontal directions or biasing using elastomeric forces etc. so as to fix the paper currency bills 2 in a state where four sides of the paper currency bills are aligned. For example, the erection parts 16*b* and 16*c* press the paper currency bills 2 so as to align them in a lateral direction (width direction). For example, the erection parts 16*d* and 16*e* press the paper currency bills 2 so as to align them in a longitudinal direction.

A leading end of the paper-currency-bill back-end presser 16*g* of the paper currency bill storing apparatus 10 presses down the paper currency bills 2, which are set in the paper currency bill storing space, by using position adjustments in the up-and-down direction or biasing using an elastomeric force etc. of the paper-currency-bill back-end presser 16*g*.

The paper currency bill storing apparatus 10 includes therein the roller part 17 that includes a separate roller 17*b* and a pick roller 17*a* (see FIG. 6B-2) in this order from the paper currency bill ejecting port 14.

Figure 6A:
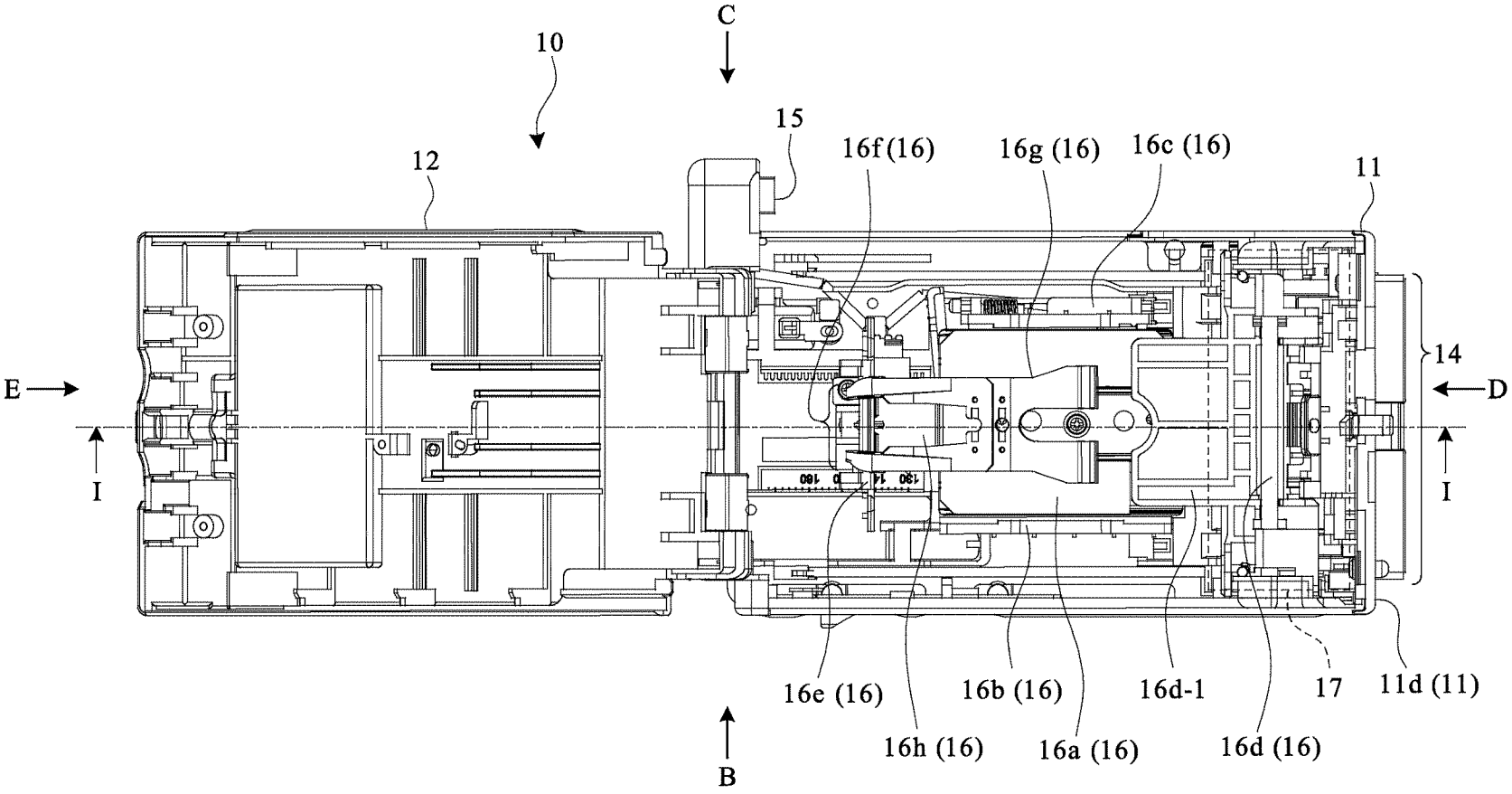
FIG. 6A is a plan view illustrating the paper currency bill storing apparatus (state where lid body is opened) according to the first embodiment viewed from the direction A illustrated in FIG. 5A.

FIG. 6A is a plan view illustrating the paper currency bill storing apparatus (state where lid body is opened) according to the embodiment viewed from the direction A illustrated in FIG. 5A. As illustrated in FIG. 6A, a paper-currency-bill leading-end presser 16*d*-1, which forms a plane substantially parallel to the bottom surface part 16*a*, is attached to an upper end of the erection part 16*d*. The paper-currency-bill leading-end presser 16*d*-1 presses down a leading-end side of the paper currency bill 2 on the direction D side, which is set in the paper currency bill storing space of the paper currency bill storing part 16.

The roller part 17 is arranged near the paper currency bill ejecting port 14 in the paper currency bill storing apparatus 10.

Figures 1, 6B:
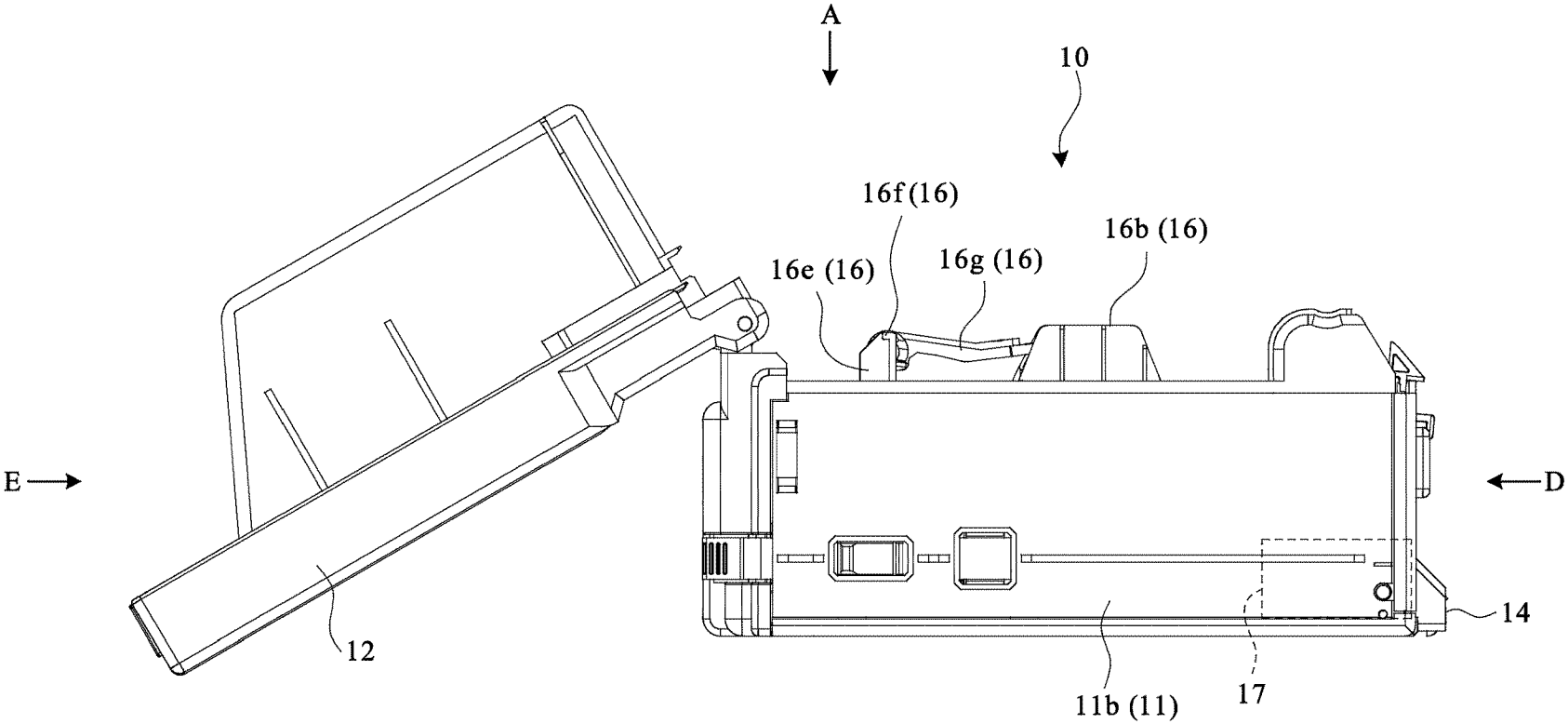
Figures 2, 6B:
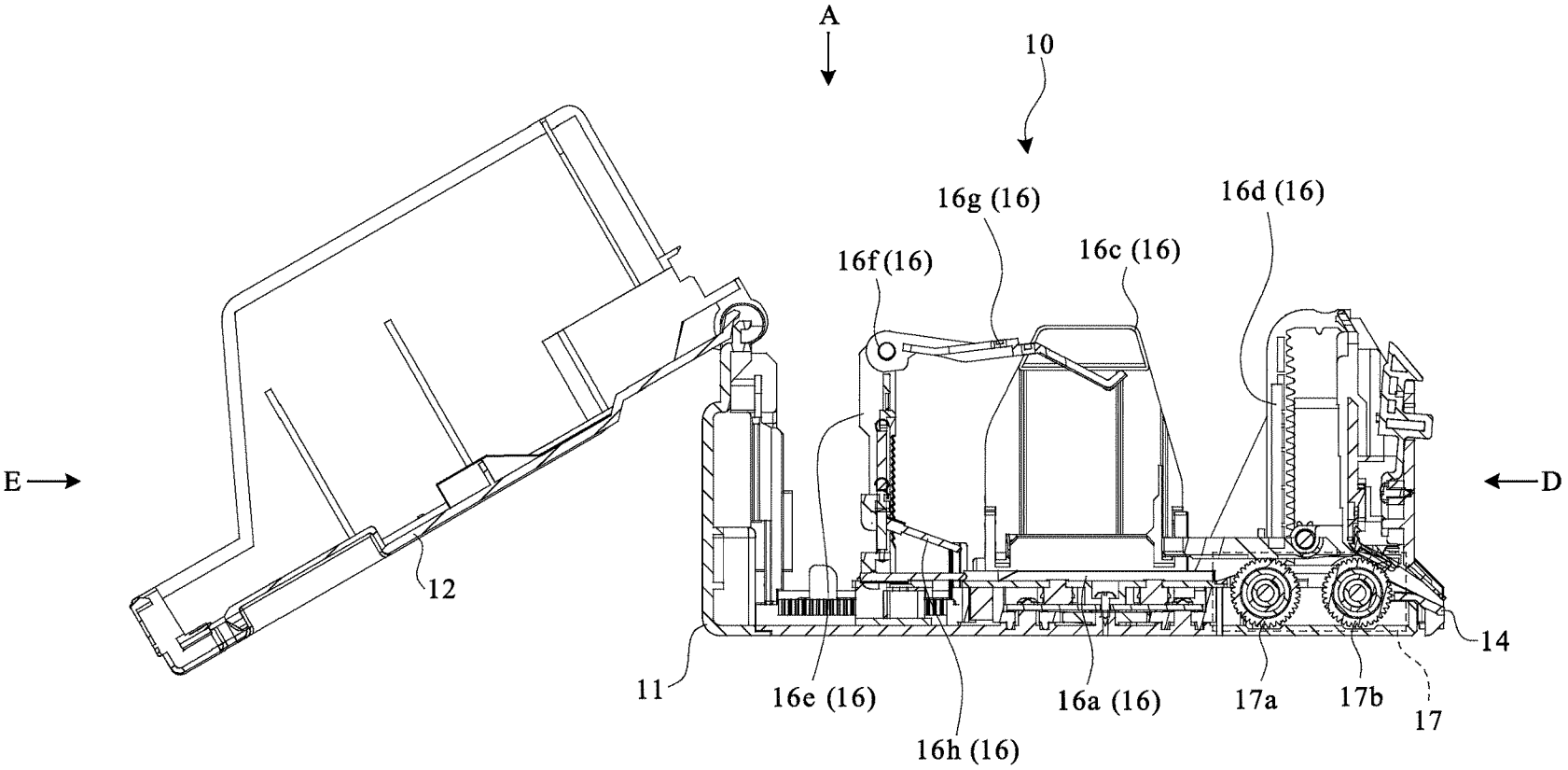
Figure 6C:
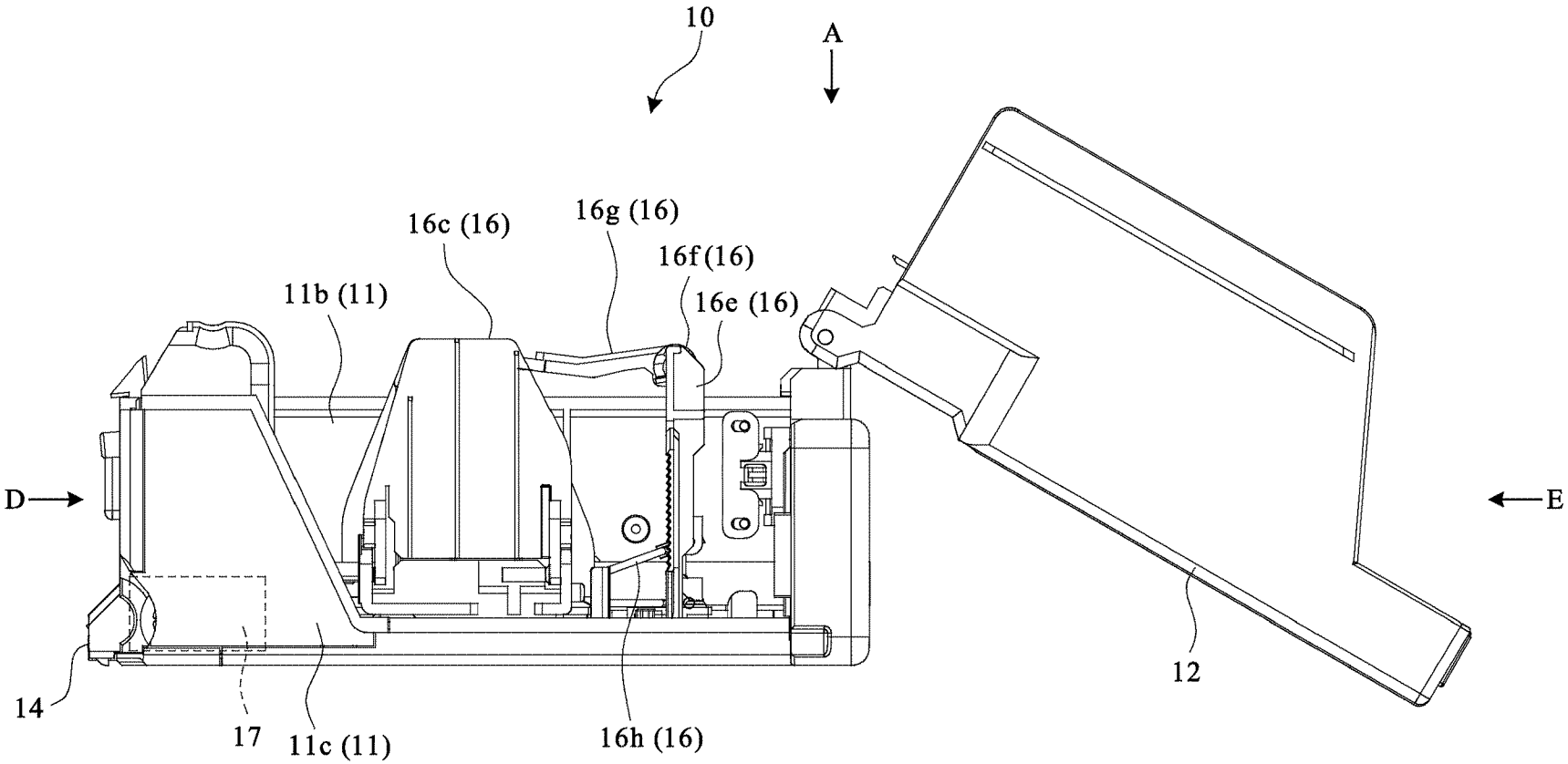
FIG. 6C is a side view illustrating the paper currency bill storing apparatus according to the first embodiment viewed from the direction C illustrated in FIG. 5A.
Figure 6D:
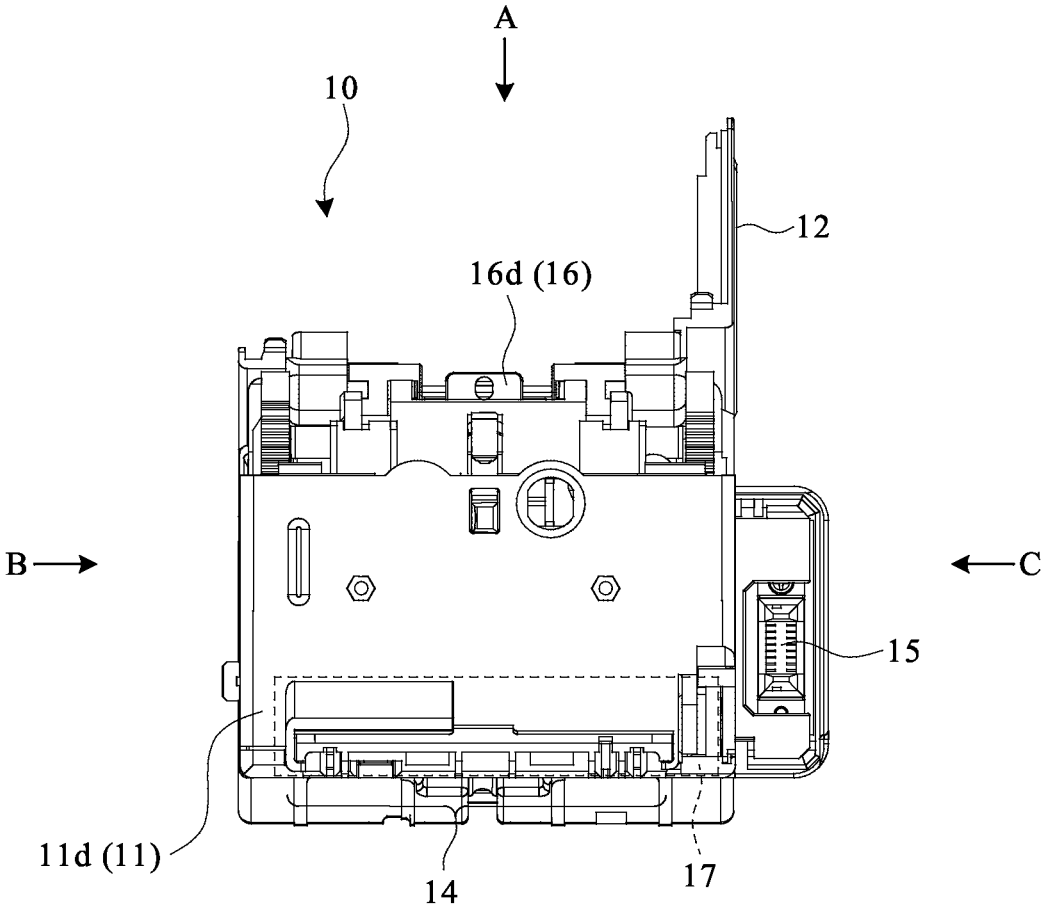
FIG. 6D is a front view illustrating the paper currency bill storing apparatus according to the first embodiment viewed from the direction D illustrated in FIG. 5A.

FIG. 6B-1 is a side view illustrating the paper currency bill storing apparatus (state where lid body is opened) according to the embodiment viewed from the direction B illustrated in FIG. 5A. FIG. 6B-2 is a cross sectional view illustrating the paper currency bill storing apparatus according to the embodiment taken along a cross section I-I illustrated in FIG. 6A. FIG. 6C is a side view illustrating the paper currency bill storing apparatus according to the embodiment viewed from the direction C illustrated in FIG. 5A. FIG. 6D is a front view illustrating the paper currency bill storing apparatus according to the embodiment viewed from the direction D illustrated in FIG. 5A.

Referring to FIG. 6B-2 as well as FIGS. 5A to 6B-1, 6C, and 6D, the paper currency bill storing apparatus 10 includes the roller part 17, which includes the pick roller 17*a* and the separate roller 17*b*, between the bottom surface part 16*a* of the paper currency bill storing part 16 and the paper currency bill ejecting port 14. On each of the pick roller 17*a* and the separate roller 17*b*, a rotation surface is formed that has the friction factor enough to feed the paper currency bill 2 by its rotation in a state of contacting with the paper currency bill 2. The pick roller 17*a* and the separate roller 17*b* forms the same drive system by a drive transmitting belt to be mentioned later, and they are rotated in the same direction by a driving force transmitted from a driving apparatus (not illustrated).

The pick roller 17*a* contacts with a neighborhood of a longitudinal leading end of the paper currency bill 2 positioned in a lowest layer among the paper currency bills 2 set in the paper currency bill storing space of the paper currency bill storing part 16, and the friction between the paper currency bill 2 and the pick roller 17*a* causes the paper currency bill storing apparatus 10 to feed the paper currency bill 2 by rotation of the pick roller 17*a*. The paper currency bill 2 fed by the pick roller 17*a* contacts with the separate roller 17*b*, and the friction between the paper currency bill 2 and the separate roller 17*b* causes the paper currency bill storing apparatus 10 to eject the paper currency bill 2 from the paper currency bill ejecting port 14 to the outside of the paper currency bill storing apparatus 10 by rotation of the separate roller 17*b*.

Roller Part According to First Embodiment

Figure 7A:
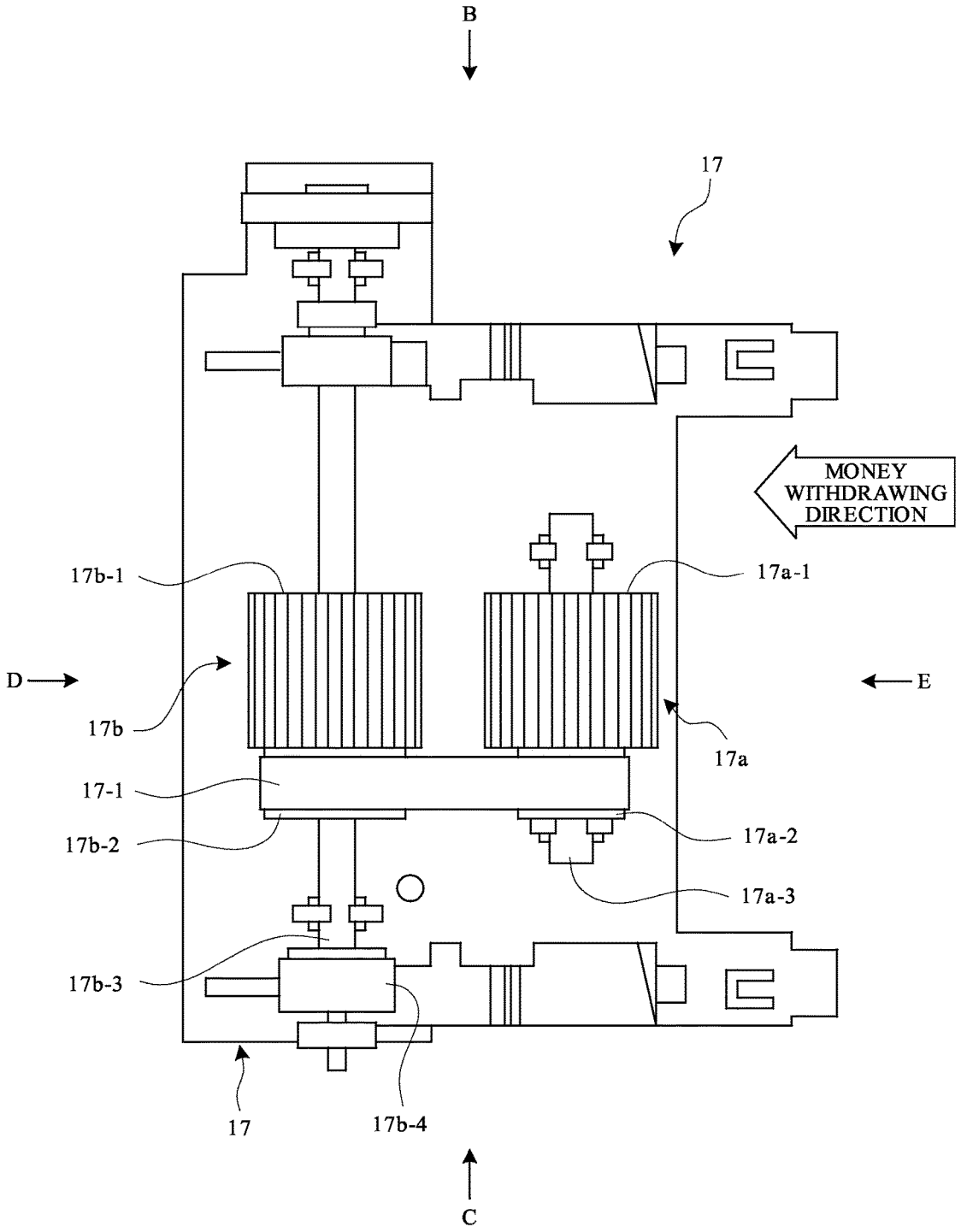
FIG. 7A is a plan view illustrating a roller part according to the first embodiment viewed from the direction A illustrated in FIG. 5B.
Figure 7B:
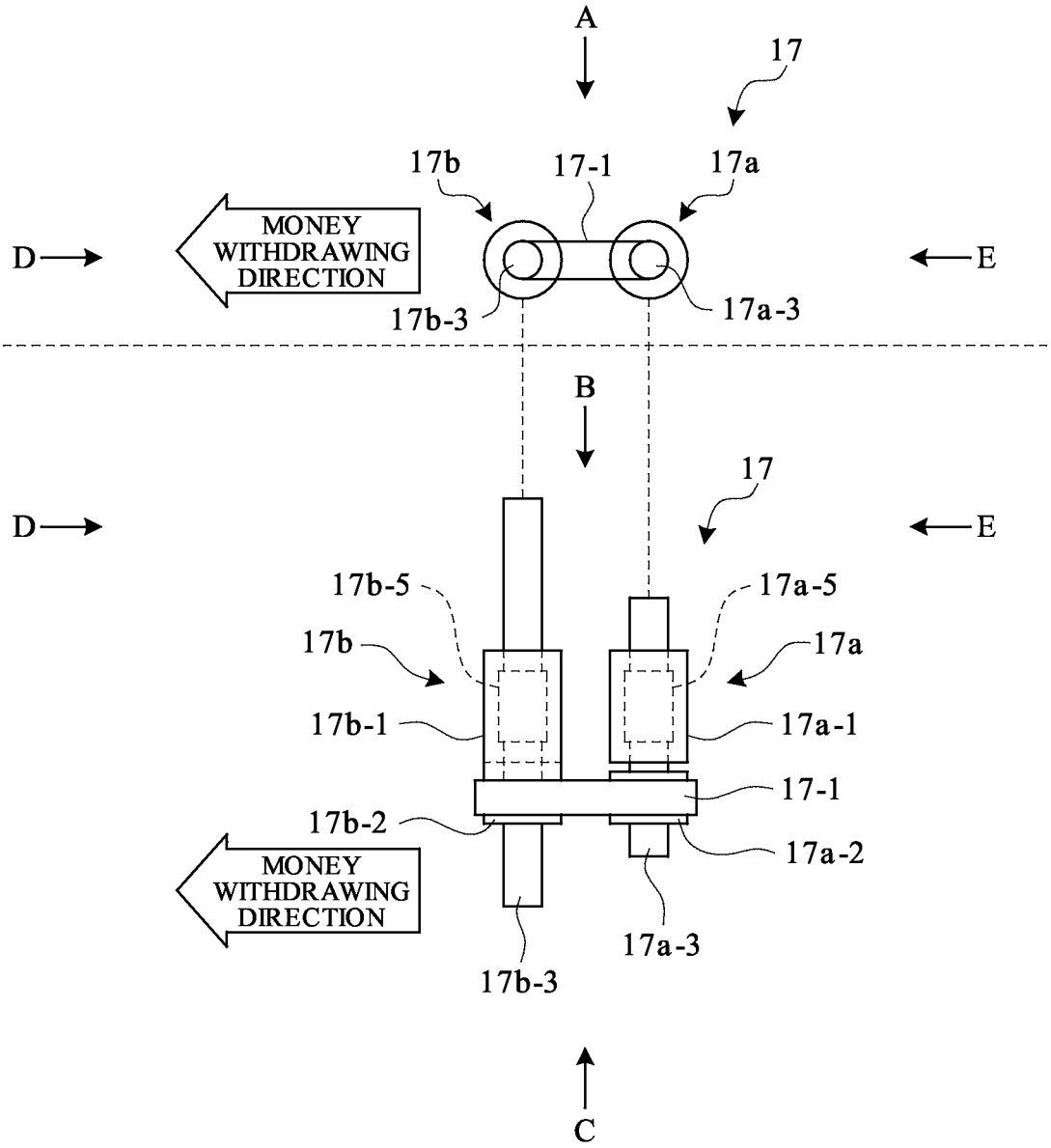
FIG. 7B is a schematic view illustrating an outline of the roller part according to the first embodiment illustrated in FIG. 7A.

FIG. 7A is a plan view illustrating the roller part according to the first embodiment viewed from the direction A illustrated in FIG. 5B. FIG. 7B is a schematic view illustrating an outline of the roller part according to the first embodiment illustrated in FIG. 7A. As illustrated in FIG. 7A, the roller part 17 includes the pick roller 17*a* and the separate roller 17*b* in a "predetermined plane" including arrows that are in the directions B to E. The "predetermined plane" forms a plane similar to the above bottom surface part 16*a*, for example.

The roller part 17 includes the pick roller 17*a* on the direction E side and the separate roller 17*b* on the direction D side. The pick roller 17*a* and the separate roller 17*b* are arranged so that their roller surfaces and rotation axes are substantially parallel to each other. When the paper currency bill 2 is fed by the roller part 17 to be sent out, the paper currency bill 2 is moved so that the longitudinal direction of the paper currency bill 2 moves from the direction E side toward the direction D side ("money withdrawing direction" illustrated in FIG. 7B).

The pick roller 17*a* includes a roller surface 17*a*-1, a pulley 17*a*-2, and a rotation shaft 17*a*-3. Both of the roller surface 17*a*-1 and the pulley 17*a*-2 are attached to the rotation shaft 17*a*-3, and are rotated in accordance with rotation of the rotation shaft 17*a*-3. A cylindrical outer periphery of the roller surface 17*a*-1 is made of material and is formed in a shape so as to frictionally contact with a plane of the paper currency bill 2 by a predetermined frictional force. Both ends of the rotation shaft 17*a*-3 are supported to be rotatable by a support part.

The roller surface 17*a*-1 is connected to the rotation shaft 17*a*-3 via a one-way clutch 17*a*-5 (see FIG. 7B). The one-way clutch 17*a*-5 transmits, to the roller surface 17*a*-1, rotation of the rotation shaft 17*a*-3 in the "money withdrawing direction", however, does not transmit, to the rotation shaft 17*a*-3, rotation of the roller surface 17*a*-1 in the "money withdrawing direction" because the rotation of the roller surface 17*a*-1 is relatively reverse rotation. Thus, for example, when the paper currency bill 2 in contact with the roller surface 17*a*-1 is forcibly pulled out regardless of an operation of the roller part 17, it is possible to separate the roller surface 17*a*-1 from the rotation shaft 17*a*-3 to be able to cause the roller surface 17*a*-1 to freely rotate for the rotation shaft 17*a*-3.

The separate roller 17*b* includes a roller surface 17*b*-1, a pulley 17*b*-2, and a rotation shaft 17*b*-3. Both of the roller surface 17*b*-1 and the roller surface 17*b*-1 are attached to the rotation shaft 17*b*-3, and are rotated in accordance with rotation of the rotation shaft 17*b*-3. A cylindrical outer periphery of the roller surface 17*b*-1 is made of material and is formed in a shape so as to frictionally contact with the plane of the paper currency bill 2 by a predetermined frictional force. Both ends of the rotation shaft 17*b*-3 are supported to be rotatable by a support part.

The roller surface 17*b*-1 is connected to the rotation shaft 17*b*-3 via a one-way clutch 17*b*-5 (see FIG. 7B). The one-way clutch 17*b*-5 transmits, to the roller surface 17*b*-1, rotation of the rotation shaft 17*b*-3 in the "money withdrawing direction", however, does not transmit, to the rotation shaft 17*b*-3, rotation of the roller surface 17*b*-1 in the "money withdrawing direction" because the rotation of the roller surface 17*b*-1 is relatively reverse rotation. Thus, for example, when the paper currency bill 2 in contact with the roller surface 17*b*-1 is forcibly pulled out regardless of an operation of the roller part 17, it is possible to separate the roller surface 17*b*-1 from the rotation shaft 17*b*-3 to be able to cause the roller surface 17*b*-1 to freely rotate for the rotation shaft 17*b*-3.

The roller surface 17*b*-1 and the pulley 17*b*-2 are formed into one body, and are rotated together in accordance with rotation of the rotation shaft 17*b*-3. A pulley 17*b*-4 is arranged at an end part on the direction C side of the rotation shaft 17*b*-3, which is for transmitting to the rotation shaft 17*b*-3 a rotation driving force transmitted from a driving apparatus (not illustrated) via a belt or a gear. The pulley 17*a*-2 and the pulley 17*b*-2 are connected with each other via a belt 17-1. The connection by the belt 17-1 causes the pulley 17*a*-2 and the pulley 17*b*-2 to rotate in the same direction.

In other words, when described with reference to FIGS. 7A and 7B, a driving force that is input via the pulley 17*b*-4 rotates the rotation shaft 17*b*-3. Rotation of the rotation shaft 17*b*-3 is transmitted via the one-way clutch 17*b*-5 so as to rotate the roller surface 17*b*-1. When the roller surface 17*b*-1 starts to rotate, the pulley 17*b*-2 accordingly starts to rotate. The rotation of the pulley 17*b*-2 is transmitted to the pulley 17*a*-2 via the belt 17-1 so as to cause the pulley 17*a*-2 to start to rotate. When the pulley 17*a*-2 rotates, the rotation shaft 17*a*-3 accordingly rotates. The rotation of the rotation shaft 17*a*-3 is transmitted via the one-way clutch 17*a*-5 so as to rotate the roller surface 17*a*-1. In this manner, the roller surface 17*b*-1 of the separate roller 17*b* on the drive shaft is controlled to rotate earlier than the roller surface 17*a*-1 of the pick roller 17*a* on the driven shaft.

Operation of Roller Part According to First Embodiment

Figure 8:
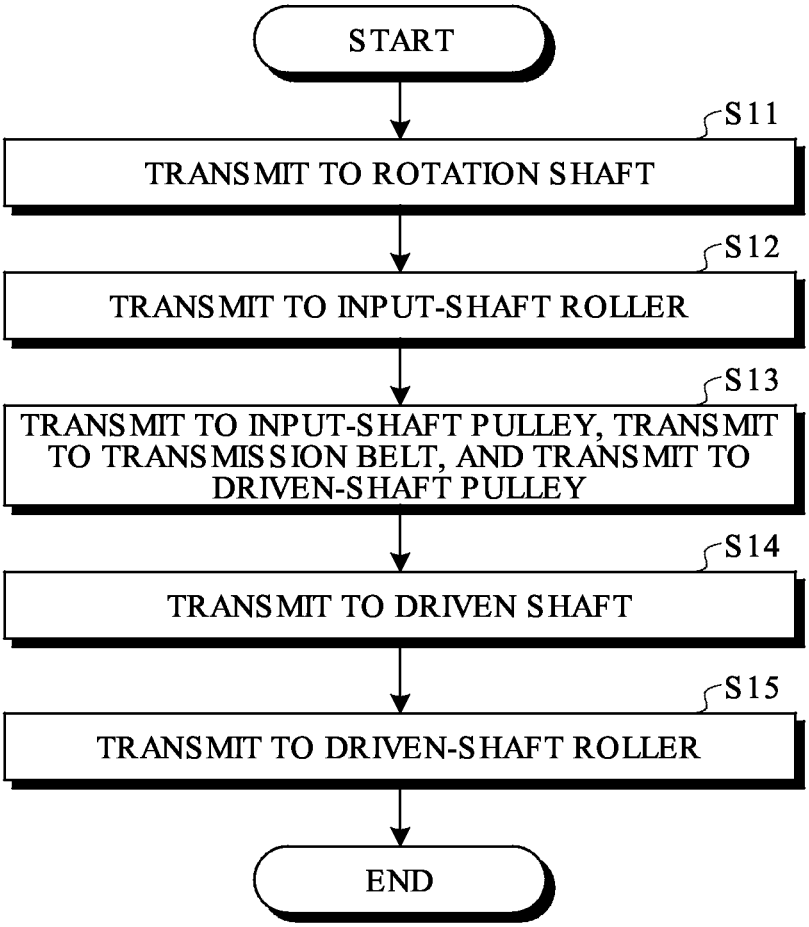
FIG. 8 is a flowchart illustrating an operation of the roller part according to the first embodiment.

FIG. 8 is a flowchart illustrating an operation of the roller part according to the first embodiment. As described above, the roller part 17 is premised on the following operation. The one-way clutch 17*a*-5 transmits, to the roller surface 17*a*-1, rotation of the rotation shaft 17*a*-3, which is an input shaft, in the "money withdrawing direction" (see FIG. 7B). On the other hand, when the paper currency bill 2 in contact with the roller surface 17*a*-1 is forcibly pulled out regardless of an operation of the roller part 17, a one-way clutch 17*a*-5 does not transmit the rotation of the roller surface 17*a*-1 to the rotation shaft 17*a*-3 so as to cause the roller surface 17*a*-1 to freely rotate for the rotation shaft 17*a*-3.

Similarly, the one-way clutch 17*b*-5 transmits, to the roller surface 17*a*-1, rotation of the rotation shaft 17*a*-3 in the "money withdrawing direction" (see FIG. 7B) that is caused by transmission of rotation from the pulley 17*b*-2 via the belt 17-1 and the pulley 17*a*-2. On the other hand, when the paper currency bill 2 in contact with the roller surface 17*a*-1 is forcibly pulled out regardless of an operation of the roller part 17, a one-way clutch 17*a*-5 does not transmit the rotation of the roller surface 17*a*-1 to the rotation shaft 17*a*-3 so as to cause the roller surface 17*a*-1 to freely rotate for the rotation shaft 17*a*-3.

In the above premise, a driving rotation by a driving apparatus (not illustrated) is transmitted to the rotation shaft 17*b*-3 that is an input shaft (Step S11). Next, the rotation transmitted to the rotation shaft 17*b*-3 is transmitted to the separate roller 17*b*, which is an input-shaft roller, via the one-way clutch 17*b*-5 (Step S12). When the rotation is transmitted to the separate roller 17*b*, the separate roller 17*b* accordingly starts to rotate.

Next, the rotation transmitted to the separate roller 17*b* is transmitted to the pulley 17*b*-2 that is an input-shaft pulley integrated with the separate roller 17*b*. The rotation transmitted to the pulley 17*b*-2 is transmitted to the belt 17-1 that is a transmission belt, and is further transmitted to the pulley 17*a*-2 that is a driven-shaft pulley (Step S13). Next, the rotation transmitted to the pulley 17*a*-2 is transmitted to the rotation shaft 17*a*-3 that is a driven shaft (Step S14). Next, the rotation transmitted to the rotation shaft 17*a*-3 is transmitted to the roller surface 17*a*-1, which is a driven-shaft roller, via the one-way clutch 17*a*-5 (Step S15). The rotation is transmitted to the roller surface 17*a*-1, the roller surface 17*a*-1 accordingly starts to rotate. In this manner, the roller surface 17*b*-1 starts to rotate by the driving rotation input to the roller part 17, and then the roller surface 17*a*-1 starts to rotate. Thus, it is possible to reduce occurrence of a jam when the roller part 17 feeds or sends out the paper currency bill 2 to be able to stably perform smooth feeding or sending-out of the paper currency bill 2.

Second Embodiment

Figure 9A:
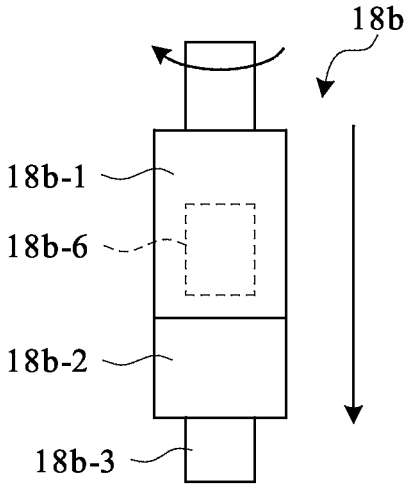
FIG. 9A is a schematic view illustrating an outline of a separate roller according to a second embodiment.
Figure 9B:
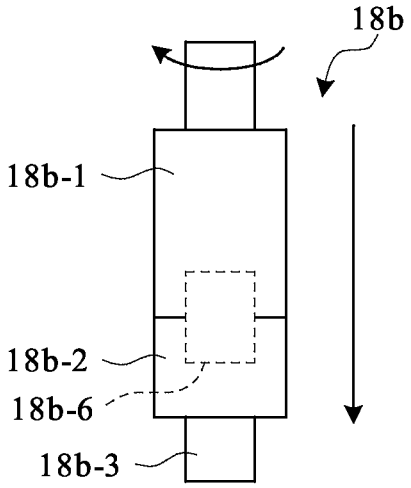
FIG. 9B is a schematic view illustrating an outline of the separate roller according to the second embodiment.

In a second embodiment, a separate roller 18*b* is employed for the roller part 17 instead of the separate roller 17*b*. Other parts according to the second embodiment are similar to those according to the first embodiment. FIGS. 9A and 9B are schematic views illustrating an outline of a separate roller according to the second embodiment.

As illustrated in FIG. 9A, the separate roller 18*b* includes a roller surface 18*b*-1, a pulley 18*b*-2, a rotation shaft 18*b*-3, and an integrating member 18*b*-6. Both of the roller surface 18*b*-1 and the pulley 18*b*-2 are attached to the rotation shaft 18*b*-3, and are rotated in accordance with rotation of the rotation shaft 18*b*-3. A cylindrical outer periphery of the roller surface 18*b*-1 is made of material and is formed in a shape so as to frictionally contact with a plane of the paper currency bill 2 by a predetermined frictional force. Both ends of the rotation shaft 18*b*-3 are supported to be rotatable by a support part.

The roller surface 18*b*-1 is connected to the rotation shaft 18*b*-3 via a one-way clutch (not illustrated). This one-way clutch transmits, to the roller surface 18*b*-1, rotation of the rotation shaft 18b-3 in the "money withdrawing direction", however, does not transmit, to the rotation shaft 18b-3, rotation of the roller surface 18b-1 in the "money withdrawing direction" because the rotation of the roller surface 18b-1 is relatively reverse rotation.

The roller surface 18b-1 and the pulley 18b-2 are separately formed. As illustrated in FIG. 9A, the integrating member 18b-6 is positioned on the rotation shaft 18b-3 inside the roller surface 18b-1 before the rotation shaft 18b-3 is rotated. When the rotation shaft 18b-3 is rotated, the integrating member 18b-6 is moved to a position on the rotation shaft 18b-3 over the insides of the roller surface 18b-1 and the pulley 18b-2, illustrated in FIG. 9B, so as to fit into the pulley 18b-2. When the integrating member 18b-6 moved to the position illustrated in FIG. 9B, the roller surface 18b-1 and the pulley 18b-2 are equally rotated as one body in accordance with the rotation of the rotation shaft 18b-3.

When the rotation of the rotation shaft 18b-3 is stopped, the integrating member 18b-6 is moved on the rotation shaft 18b-3 into the inside of the roller surface 18b-1, illustrated in FIG. 9A, from the position illustrated in FIG. 9B by a restoration force etc. The integrating member 18b-6 is a piece, for example.

Comparison with Conventional Technology

Figure 10:
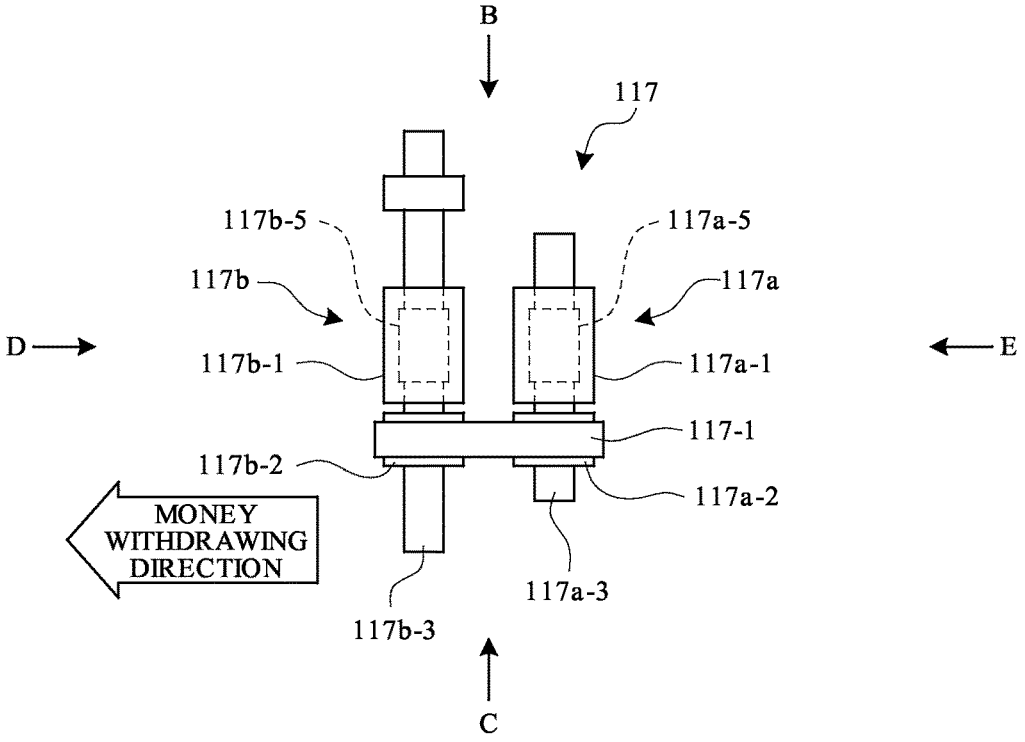
FIG. 10 is a schematic view illustrating an outline of a roller part according to a conventional technology.

FIG. 10 is a schematic view illustrating an outline of a roller part according to a conventional technology. A roller part 117 according to the conventional technology includes a pick roller 117a on the direction E side and a separate roller 117b on the direction D side. The pick roller 117a and the separate roller 117b are arranged so that their roller surfaces and rotation axes are substantially parallel to each other. When the paper currency bill 2 is fed by the roller part 117 to be sent out, the paper currency bill 2 is moved so that the longitudinal direction of the paper currency bill 2 moves from the direction E side toward the direction D side ("money withdrawing direction" illustrated in FIG. 10).

The pick roller 117a includes a roller surface 117a-1, a pulley 117a-2, and a rotation shaft 117a-3. Both of the roller surface 117a-1 and the pulley 117a-2 are attached to the rotation shaft 117a-3, and are rotated in accordance with rotation of the rotation shaft 117a-3. Both ends of the rotation shaft 117a-3 are supported to be rotatable by a support part.

The roller surface 117a-1 is connected to the rotation shaft 117a-3 via a one-way clutch 117a-5. The one-way clutch 117a-5 transmits, to the roller surface 117a-1, rotation of the rotation shaft 117a-3 in the "money withdrawing direction", however, does not transmit, to the rotation shaft 117a-3, rotation of the roller surface 117a-1 in the "money withdrawing direction" because the rotation of the roller surface 117a-1 is relatively reverse rotation.

The separate roller 117b includes a roller surface 117b-1, a pulley 117b-2, and a rotation shaft 117b-3. Both of the roller surface 117b-1 and the pulley 117b-2 are attached to the rotation shaft 117b-3, and are rotated in accordance with rotation of the rotation shaft 117b-3. Both ends of the rotation shaft 117b-3 are supported to be rotatable by a support part.

The roller surface 117b-1 is connected to the rotation shaft 117b-3 via a one-way clutch 117b-5. The one-way clutch 117b-5 transmits, to the roller surface 117b-1, rotation of the rotation shaft 117b-3 in the "money withdrawing direction", however, does not transmit, to the rotation shaft 117b-3, rotation of the roller surface 117b-1 in the "money withdrawing direction" because the rotation of the roller surface 117b-1 is relatively reverse rotation.

The roller surface 117b-1 and the pulley 117b-2 are separately formed. When the rotation shaft 117b-3 is rotated, the rotation is accordingly transmitted to the roller surface 117b-1 via the one-way clutch 117b-5, on the other hand, the rotation is directly transmitted to the pulley 117b-2. The pulley 117a-2 and the pulley 117b-2 are connected with each other via a belt 117-1. The connection by using the belt 117-1 causes the pulley 117a-2 and the pulley 117b-2 to rotate in the same direction.

The driving rotation input to the rotation shaft 117b-3, which is an input shaft, is transmitted to the roller surface 117b-1 earlier than the roller surface 117a-1. In other words, the roller surface 117b-1 of the separate roller 117b on the drive shaft is controlled to rotate earlier than the roller surface 117a-1 of the pick roller 117a on the driven shaft.

Figure 11:
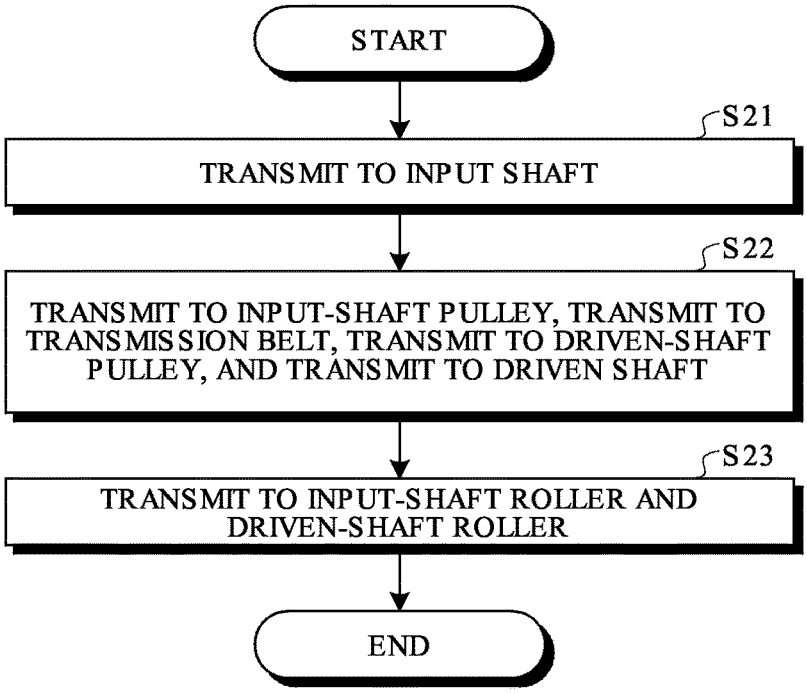
FIG. 11 is a flowchart illustrating an operation of the roller part according to the conventional technology.

Comparison between Operations of Roller Parts According to First Embodiment and Conventional Technology FIG. 11 is a flowchart illustrating an operation of the roller part according to the conventional technology. First, a driving rotation by a driving apparatus (not illustrated) is transmitted to the rotation shaft 117b-3 that is an input shaft (Step S21). Next, the rotation transmitted to the rotation shaft 117b-3 is transmitted to the pulley 117b-2 that is an input-shaft pulley. The rotation transmitted to the pulley 117b-2 is further transmitted to the belt 117-1 that is a transmission belt, is further transmitted to the pulley 117a-2 that is a driven-shaft pulley, and is transmitted to the rotation shaft 117a-3 that is a driven shaft (Step S22). The rotation of the rotation shaft 117b-3 is transmitted to the roller surface 117b-1 and the roller surface 117b-1 accordingly starts to rotate, and the rotation of the rotation shaft 117a-3 is transmitted to the roller surface 117a-1 and the roller surface 117a-1 accordingly starts to rotate (Step S23).

However, in Step S23, the roller surface 117b-1 does not always start to rotate earlier than the roller surface 117a-1 due to play of the one-way clutches 117a-5, 117b-5 and gear ratios of the pulley 117a-2, 117b-2, among other things.

Figure 12A:
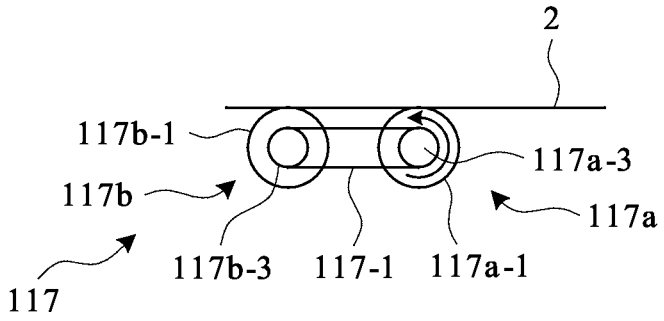
FIG. 12A is a schematic view illustrating an outline of a jam occurrence in the roller part according to the conventional technology.
Figure 12B:
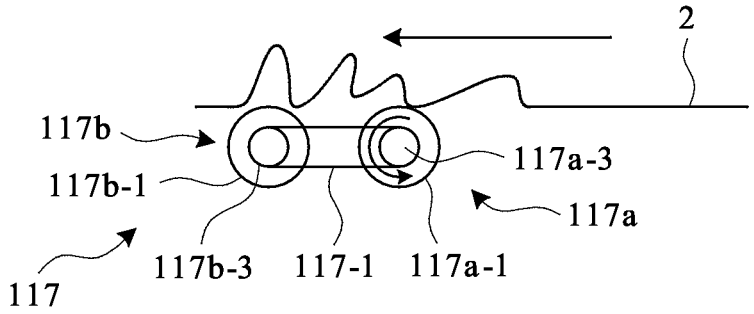
FIG. 12B is a schematic view illustrating the outline of the jam occurrence in the roller part according to the conventional technology.

Thus, as illustrated in FIG. 12A, it is assumed that, when the paper currency bill 2 is fed by using the pick roller 117a and the separate roller 117b, the roller surface 117a-1 of the pick roller 117a earlier starts to rotate, for example. There exists a case where the roller surface 117b-1 of the separate roller 117b does not yet start to rotate after the roller surface 117a-1 has started to rotate. In such a case, as illustrated in FIG. 12B, when the roller part 117 sends out the paper currency bill 2, the paper currency bill 2 is paper-jammed near the roller surface 117b-1 of the separate roller 117b to generate a jam.

Figure 13A:
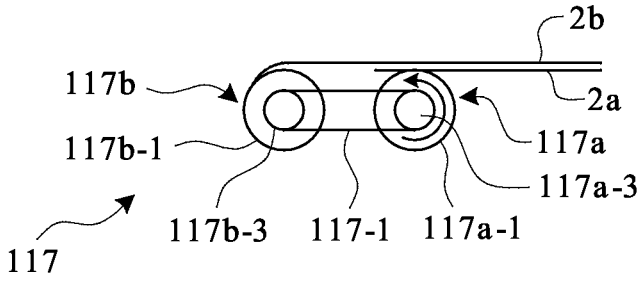
FIG. 13A is a schematic view illustrating an outline of a jam occurrence in the roller part according to the conventional technology.
Figure 13B:
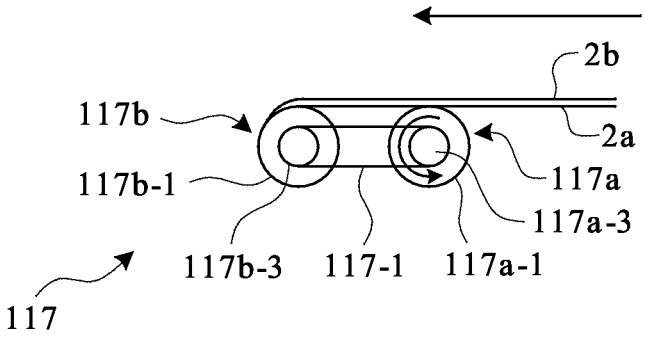
FIG. 13B is a schematic view illustrating the outline of the jam occurrence in the roller part according to the conventional technology.

As illustrated in FIG. 13A, it is assumed that the pick roller 117a and the separate roller 117b feed a paper currency bill 2a and a paper currency bill 2b that is put on the paper currency bill 2a and whose length is larger than that of the paper currency bill 2a. There exists a case where the roller surface 117b-1 of the separate roller 117b does not yet start to rotate after the roller surface 117a-1 of the pick roller 117a has started to rotate, for example. In this case, as illustrated in FIG. 13B, when the roller part 117 sends out the paper currency bills 2a, 2b, the paper currency bill 2a earlier reaches the roller surface 117b-1 of the separate roller 117b. Next, the separate roller 117b is to feed the overlapped paper currency bills 2a, 2b, and the paper currency bills 2a, 2b are paper-jammed to generate a jam.

In other words, in the first and second embodiments, when a paper sheet is fed by using a first roller arranged on the input shaft and a second roller arranged on the driven shaft that are driven to rotate, the driven shaft is driven by rotation transmitted, via a belt, from a pulley integrated with the first roller. Thus, it is possible to reduce the paper jam and the paper-sheet disturbance during an ejection of a paper sheet/paper sheets, which have occurred in the conventional technology as described above, to be able to perform a smooth paper-sheet ejection at constant intervals.

In the first and second embodiments, the roller part 17 is exemplified to include the one-way clutches 17*a*-5, 17*b*-5, not limited thereto, the disclosed technology may include no one-way clutch. In other words, a time lag that occurs when rotation is transmitted to the roller on the rotation shaft does not always caused by play etc. of the one-way clutch that is a medium for transmitting rotation from the rotation shaft to the roller. For example, a factor in the time lag that occurs when rotation is transmitted to the roller on the rotation shaft may be idle rotation of the roller for the rotation shaft etc. Thus, a configuration not including the one-way clutches 17*a*-5, 17*b*-5 may be included in the disclosed technology.

The roller on the drive shaft, among the rollers on the drive shaft and the driven shaft, may be a greater factor in the time lag that occurs when rotation is transmitted to the roller on the rotation shaft in some cases. Thus, a configuration, in which the separate roller 17*b* includes the one-way clutch 17*b*-5 and the pick roller 17*a* does not include the one-way clutch 17*a*-5 may be included in the disclosed technology.

In the first and second embodiments, the configuration is exemplified in which the roller surface 17*b*-1 and the pulley 17*b*-2 of the separate roller 17*b* among the pick roller 17*a* and the separate roller 17*b*, which is closer to the paper currency bill ejecting port 14, are integrated with each other. However, not limited thereto, a roller surface and a pulley, of the disclosed technology, arranged on a roller to which a rotation driving force is input may be integrated with each other, regardless of the arrangement position. For example, when a rotation driving force is input to the pick roller 17*a*, the roller surface 17*a*-1 and the pulley 17*a*-2 may be integrated with each other.

In the first and second embodiments, the roller part 17 includes the pick roller 17*a* and the separate roller 17*b*, not limited thereto, rollers having the same type may be respectively arranged on the drive side and the driven side.

The paper sheet storing apparatus, the paper sheet handling apparatus, and the paper sheet feeding method according to the disclosed technology may be embodied by modification of their components without departing from the substance thereof upon their implementation. Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

According to an aspect of a disclosed technology, it is possible to provide a paper sheet storing apparatus, a paper sheet handling apparatus, and a paper sheet feeding method, which is able to reduce the occurrence of a paper-sheet jam.

All examples and conditional language provided herein are intended for the pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet storing apparatus comprising:
- a storage part that stores paper sheets;
- an ejection port that ejects a paper sheet of the paper sheets stored in the storage part;
- a drive shaft;
- a first roller that is arranged near the ejection port, and is rotated in a predetermined direction by transmission of rotation caused by drive of the drive shaft so as to send out the paper sheet stored in the storage part from the ejection port;
- a first pulley that is arranged on the drive shaft and operates in a state integrated with the first roller;
- a driven shaft that is rotated in the predetermined direction following the rotation of the first roller in the predetermined direction caused by the transmission of the driving rotation of the drive shaft, the rotation of the first roller being transmitted via the first pulley;
- a second pulley that is arranged on the driven shaft;
- a belt that connects the first pulley and the second pulley with each other so as to transmit, via the first and second pulleys, rotation of the first roller in the predetermined direction to the driven shaft; and
- a second roller that is arranged in a position farther from the ejection port than a position in which the first roller is arranged, and is rotated in the predetermined direction by transmission of rotation of the driven shaft in the predetermined direction so as to sequentially feed, to the first roller, the paper sheets stored in the storage part from a paper sheet positioned in a lowest layer among the paper sheets, wherein the first roller is rotated in the predetermined direction by transmission of rotation caused by drive of the drive shaft, the transmission being via a first one-way clutch.

2. The paper sheet storing apparatus according to claim 1, wherein the second roller is rotated in the predetermined direction by transmission of rotation of the driven shaft in the predetermined direction, the transmission being via a second one-way clutch.

3. The paper sheet storing apparatus according to claim 1, wherein the first pulley is integrated with the first roller.

4. The paper sheet storing apparatus according to claim 1, wherein
- the first pulley is arranged on the drive shaft separately from the first roller;
- the paper sheet storing apparatus further comprises an integrating member that integrates the first roller and the first pulley into one body when the first roller is rotated in the predetermined direction; and
- the first pulley is integrated with the first roller by the integrating member.

5. A paper sheet handling apparatus comprising:
- a casing;
- a housing part; and
- a paper sheet storing apparatus that is housed in the housing part,
- the paper sheet storing apparatus comprising:
  - a storage part that stores paper sheets;
  - an ejection port that ejects a paper sheet of the paper sheets stored in the storage part;
  - a drive shaft;
  - a first roller that is arranged near the ejection port, and is rotated in a predetermined direction by transmission, via a first one-way clutch, of rotation caused by drive of the drive shaft so as to send out the paper sheet stored in the storage part from the ejection port;

a driven shaft that is rotated in the predetermined direction following the rotation of the first roller in the predetermined direction caused by the transmission of the driving rotation of the drive shaft; and a second roller that is arranged in a position farther from the ejection port than a position in which the first roller is arranged, and is rotated in the predetermined direction by transmission, via a second one-way clutch, of rotation of the driven shaft in the predetermined direction so as to sequentially feed, to the first roller, the paper sheets stored in the storage part from a paper sheet positioned in a lowest layer among the paper sheets.

6. A paper sheet feeding method comprising:

driving a drive shaft;

rotating a first roller in a predetermined direction by transmission, via a first one-way clutch, of rotation caused by drive of the drive shaft so as to send out, from an ejection port, a paper sheet of paper sheets stored in a paper sheet storing apparatus, the first roller being arranged near the ejection port that ejects the paper sheet stored in the storage part;

rotating a driven shaft in the predetermined direction following the rotation of the first roller in the predetermined direction caused by the transmission of the driving rotation of the drive shaft; and rotating a second roller in the predetermined direction by transmission, via a second one-way clutch, of rotation of the driven shaft in the predetermined direction so as to sequentially feed, to the first roller, the paper sheets stored in the paper sheet storing apparatus from a paper sheet positioned in a lowest layer among the paper sheets, the second roller being arranged in a position farther from the ejection port than a position in which the first roller is arranged inside the paper sheet storing apparatus.

* * * * *